US006274540B1

(12) United States Patent
Scheibel et al.

(10) Patent No.: US 6,274,540 B1
(45) Date of Patent: Aug. 14, 2001

(54) DETERGENT COMPOSITIONS CONTAINING MIXTURES OF CRYSTALLINITY-DISRUPTED SURFACTANTS

(75) Inventors: Jeffrey John Scheibel; Thomas Anthony Cripe; Kevin Lee Kott, all of Loveland; Daniel Stedman Connor; James Charles Theophile Roger Burckett-St. Laurent, both of Cincinnati; Phillip Kyle Vinson, Fairfield, all of OH (US)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 09/479,369

(22) Filed: Jan. 7, 2000

Related U.S. Application Data

(63) Continuation of application No. PCT/IB98/01102, filed on Jul. 20, 1998

(60) Provisional application No. 60/053,319, filed on Jul. 21, 1997.

(51) Int. Cl.[7] ..... C11D 17/00

(52) U.S. Cl. ..... 510/352; 510/357; 510/424; 510/426; 510/428

(58) Field of Search ..... 510/424, 466, 510/428, 357, 352

(56) References Cited

U.S. PATENT DOCUMENTS

| | | | |
|---|---|---|---|
| 2,477,382 | 7/1949 | Lewis | 260/671 |
| 2,564,072 | 8/1951 | Lien et al. | 260/671 |
| 3,196,174 | 7/1965 | Cohen | 260/505 |
| 3,238,249 | 3/1966 | Mirviss et al. | 260/505 |
| 3,312,745 | 4/1967 | Habeshaw et al. | 260/638 |
| 3,341,614 | 9/1967 | Wirth et al. | 260/671 |
| 3,351,654 | 11/1967 | Gudelis | 260/505 |

(List continued on next page.)

FOREIGN PATENT DOCUMENTS

| | | | |
|---|---|---|---|
| 39394/89 | 2/1990 | (AU) | C07C/2/02 |
| 2201953 | 10/1997 | (CA) | C07C/5/27 |
| 42 24 947 | 2/1994 | (DE) | C11D/3/386 |
| 42 36 698 | 2/1994 | (DE) | C11D/3/386 |
| 0 321 177 | 6/1989 | (EP) | C01B/33/34 |
| 0 364 012 | 4/1990 | (EP) | C07C/303/24 |
| 0 466 558 | 1/1992 | (EP) | C07C/15/107 |
| 0 469 940 | 2/1992 | (EP) | C07C/15/107 |
| 0 807 616 | 11/1997 | (EP) | C07C/2/70 |
| 2697246 | 4/1994 | (FR) | C07C/15/107 |
| 936 882 | 9/1963 | (GB) . | |
| 2 083 490 | 3/1982 | (GB) . | |
| 2 278 125 | 11/1994 | (GB) | C11D/1/12 |
| 793972 | 1/1981 | (RU) | C07C/2/22 |
| WO 88/07030 | 9/1988 | (WO) | C07C/2/32 |
| WO 95/17961 | 7/1995 | (WO) | B01J/29/06 |
| WO 95/18084 | 7/1995 | (WO) | C07C/5/27 |
| WO 95/21225 | 8/1995 | (WO) | C09K/7/00 |
| WO 97/01521 | 1/1997 | (WO) | C07C/1/04 |
| WO 97/29063 | 8/1997 | (WO) | C07C/15/107 |
| WO 97/29064 | 8/1997 | (WO) | C07C/15/107 |
| WO 97/47573 | 12/1997 | (WO) | C07C/2/66 |

OTHER PUBLICATIONS

U.S. Patent application No. 09/478,908, Scheibel et al., filed Jan. 7, 2000.

U.S. Patent application No. 09/479,365, Kott et al., filed Jan. 7, 2000.

U.S. Patent application No. 09/478,909, Scheibel et al., filed Jan. 7, 2000.

U.S. Patent application No. 09/478,805, Scheibel et al., filed Jan. 7, 2000.

U.S. Patent application No. 09/479,364, Connor et al., filed Jan. 7, 2000.

"Petroleum–Based Raw Materials for Anionic Surfactants", Surfactant Science Series, vol. 7, Part 1,Chapter 2, pp. 11–86, Ed. W. M. Linfield, Marcel Dekker, Inc., New York (1996).

Nooi, J. R., et al., "Isomerization Reactions Occurring on Alkylation of Benzene with Some Branched Long–Chain 1–Alkenes", Recueil, vol. 88, No. 4, pp. 398–410 (1969).

Research Dislcosure No. 41412, "Hydrocarbon Mixture", Research Disclosure, vol. 414 (Oct. 1998).

*Primary Examiner*—Necholus Ogden
(74) *Attorney, Agent, or Firm*—C. Brant Cook; Ian S. Robinson; Kim Wm. Zerby

(57) ABSTRACT

A cleaning composition comprising:

a) about 0.1% to about 99.9% by weight of said composition of an alkylarylsulfonate surfactant system comprising from about 10% to about 100% by weight of said surfactant system of two or more crystallinity-disrupted alkylarylsulfonate surfactants of formula (B-Ar-D)a(Mq+)b(Defined herein after); and b) from about 0.00001% to about 99.9% by weight of said composition of cleaning composition adjunct ingredients, at least one of which is selected from the group consisting of: i) detersive enzymes; ii) organic detergent builders; iii) oxygen bleaching agent; iv) bleach activators; v) transition metal bleach catalysts; vi) oxygen transfer agents and precursors; vii) polymeric soil release agents; viii) water-soluble ethoxylated amines having clay soil removal and antiredeposition properties; ix) polymeric dispersing agents; x) polymeric dye transfer inhibiting agents; xi) alkoxylated polycarboxylates; and xii) mixtures thereof.

20 Claims, No Drawings

U.S. PATENT DOCUMENTS

| | | | |
|---|---|---|---|
| 3,355,484 | 11/1967 | Bloch | 260/505 |
| 3,427,342 | 2/1969 | Brooks et al. | 260/458 |
| 3,442,964 | 5/1969 | Oldham | 260/671 |
| 3,442,965 | 5/1969 | Oldham | 260/671 |
| 3,491,030 | 1/1970 | Fields | 252/161 |
| 3,492,364 | 1/1970 | Jones et al. | 260/671 |
| 3,562,797 | 2/1971 | Hu | 260/683.3 |
| 3,674,885 | 7/1972 | Griesinger et al. | 260/671 |
| 4,235,810 | 11/1980 | Osselet et al. | 260/505 |
| 4,259,193 | 3/1981 | Tirtiaux et al. | 252/33 |
| 4,301,316 | 11/1981 | Young | 585/455 |
| 4,301,317 | 11/1981 | Young . | |
| 4,447,664 | 5/1984 | Murchison et al. | 585/323 |
| 4,533,651 | 8/1985 | Masters et al. | 502/117 |
| 4,587,374 | 5/1986 | Peters | 585/670 |
| 4,645,623 | 2/1987 | Dolan et al. | 252/558 |
| 4,731,497 | 3/1988 | Grey | 585/455 |
| 4,855,527 | 8/1989 | Page et al. | 585/527 |
| 4,870,038 | 9/1989 | Page et al. | 502/62 |
| 4,959,491 | 9/1990 | Threlkel | 562/94 |
| 4,962,256 | 10/1990 | Le et al. | 585/467 |
| 4,973,788 | 11/1990 | Lin et al. | 585/511 |
| 4,990,718 | 2/1991 | Pelrine | 585/455 |
| 4,996,386 | 2/1991 | Hamilton, Jr. et al. | 585/646 |
| 5,026,933 | 6/1991 | Blain et al. | 585/7 |
| 5,030,785 | 7/1991 | Huss, Jr. et al. | 585/456 |
| 5,087,788 | 2/1992 | Wu | 585/512 |
| 5,146,026 | 9/1992 | Berna Tejero et al. | 585/467 |
| 5,177,280 | 1/1993 | Juguin et al. | 585/323 |
| 5,196,574 | 3/1993 | Kocal | 562/94 |
| 5,196,624 | 3/1993 | Threlkel et al. | 585/513 |
| 5,196,625 | 3/1993 | Threlkel et al. | 585/513 |
| 5,198,595 | 3/1993 | Lee et al. | 585/467 |
| 5,210,060 | 5/1993 | Radlowski et al. | 502/202 |
| 5,243,116 | 9/1993 | Lee et al. | 585/467 |
| 5,245,072 | 9/1993 | Giancobbe et al. | 560/99 |
| 5,246,566 | 9/1993 | Miller | 208/27 |
| 5,258,566 | 11/1993 | Kresge et al. | 585/467 |
| 5,302,732 | 4/1994 | Steigleder et al. | 554/98 |
| 5,326,928 | 7/1994 | Benazzi et al. | 585/820 |
| 5,334,793 | 8/1994 | Kocal | 585/323 |
| 5,344,997 | 9/1994 | Kocal | 568/628 |
| 5,401,896 | 3/1995 | Kuehl et al. | 585/455 |
| 5,491,271 | 2/1996 | Marinangel et al. | 585/468 |
| 5,510,306 | 4/1996 | Murray | 502/64 |
| 5,602,292 | 2/1997 | Perego et al. | 585/750 |
| 5,625,105 | 4/1997 | Lin et al. | 585/511 |
| 5,811,612 | 9/1998 | Girotti et al. | 585/467 |
| 5,811,623 | 9/1998 | Ryu et al. | 585/671 |

DETERGENT COMPOSITIONS CONTAINING MIXTURES OF CRYSTALLINITY-DISRUPTED SURFACTANTS

CROSS REFERENCE

This is a continuation under 35 USC §120 of PCT International Application Serial No. PCT/IB98/01102, filed Jul. 20, 1998; which claims priority to Provisional Application Serial No. 60/053,319, filed Jul. 21, 1997.

FIELD OF THE INVENTION

The present invention relates to cleaning compositions comprising a alkylarylsulfonate surfactant system containing a mixture of isomers of crystallinity-disrupted, preferably branched, alkylarylsulfonate surfactants and optionally one or more noncrystallinity-disrupted alkylarylsulfonate surfactants. The cleaning compositions also contain a cleaning additive selected from a detersive enzymes, organic detergent builders, oxygen bleaching agent, bleach activators, transition metal bleach catalysts, oxygen transfer agents and precursors, polymeric soil release agents, water-soluble ethoxylated amines having clay soil removal and antiredeposition properties, polymeric dispersing agents, polymeric dye transfer inhibiting agents, alkoxylated polycarboxylates and mixtures thereof. The cleaning composition also typically contains additional cleaning composition adjunct ingredients. These cleaning compositions are especially useful in detergent compositions which will be used in laundry processes involving hard water or low water temperature wash conditions.

BACKGROUND OF THE INVENTION

Historically, highly branched alkylbenzenesulfonate surfactants, such as those based on tetrapropylene (known as "ABS") were used in detergents. However, these were found to be very poorly biodegradable. A long period followed of improving manufacturing processes for alkylbenzenesulfonates, making them as linear as practically possible ("LAS"). The overwhelming part of a large art of linear alkylbenzenesulfonate surfactant manufacture is directed to this objective. All relevant large-scale commercial alkylbenzenesulfonate processes in use today are directed to linear alkylbenzenesulfonates. However, linear alkylbenzenesulfonates are not without limitations; for example, they would be more desirable if improved for hard water and/or cold water cleaning properties. Thus, they can often fail to produce good cleaning results, for example when formulated with nonphosphate builders and/or when used in hard water areas.

As a result of the limitations of the alkylbenzenesulfonates, consumer cleaning formulations have often needed to include a higher level of cosurfactants, builders, and other additives than would have been needed given a superior alkylbenzenesulfonate.

Accordingly it would be very desirable to simplify detergent formulations and deliver both better performance and better value to the consumer. Moreover, in view of the very large tonnages of alkylbenzenesulfonate surfactants and detergent formulations used worldwide, even modest improvements in performance of the basic alkylbenzenesulfonate detergent could carry great weight.

To understand the art of making and use of sulfonated alkylaromatic detergents, one should appreciate that it has gone through many stages and includes (a) the early manufacture of highly branched nonbiodegradable LAS (ABS); (b) the development of processes such as HF or AlCl3 catalyzed process (note each process gives a different composition, e.g., HF/olefin giving lower 2-phenyl or classic AlCl3/chloroparaffin typically giving byproducts which though perhaps useful for solubility are undesirable for biodegradation); (c) the market switch to LAS in which a very high proportion of the alkyl is linear; (d) improvements, including so-called 'high 2-phenyl' or DETAL processes (in fact not really "high" 2-phenyl owing to problems of solubility when the hydrophobe is too linear); and (e) recent improvements in the understanding of biodegradation.

The art of alkylbenzenesulfonate detergents is extraordinarily replete with references which teach both for and against almost every aspect of these compositions. For example, some of the art teaches toward high 2-phenyl LAS as desirable, while other art teaches in exactly the opposite direction. There are, moreover, many erroneous teachings and technical misconceptions about the mechanism of LAS operation under in-use conditions, particularly in the area of hardness tolerance. The large volume of such references debases the art as a whole and makes it difficult to select the useful teachings from the useless without large amounts of repeated experimentation. To further understand the state of the art, it should be appreciated that there has been not only a lack of clarity on which way to go to fix the unresolved problems of linear LAS, but also a range of misconceptions, not only in the understanding of biodegradation but also in basic mechanisms of operation of LAS in presence of hardness. According to the literature, and general practice, surfactants having alkali or alkaline earth salts that are relatively insoluble (their Na or Ca salts have relatively high Krafft temperature) are less desirable than those having alkali or alkaline earth salts which are relatively higher in solubility (Na or Ca salts have lower Krafft temperature). In the literature, LAS mixtures in the presence of free Ca or Mg hardness are said to precipitate. It is also known that the 2- or 3-phenyl or "terminal" isomers of LAS have higher Krafft temperatures than, say, 5- or 6-phenyl "internal" isomers. Therefore, it would be expected that changing an LAS composition to increase the 2- and 3-phenyl isomer content would decrease the hardness tolerance and solubility: not a good thing. On the other hand it is also known that with built conditions under which both the 2- and 3-phenyl and internal-phenyl isomers at equal chain length can be soluble, the 2- and 3-phenyl isomers are more surface-active materials. Therefore, it would be expected that changing an LAS composition to increase the 2- and 3-phenyl isomer content may increase the cleaning performance. However, the unsolved problems with solubility, hardness tolerance, and low temperature performance still remain.

BACKGROUND ART

U.S. Pat. No. 5,026,933; U.S. Pat. No. 4,990,718; U.S. Pat. No. 4,301,316; U.S. Pat. No. 4,301,317; U.S. Pat. No. 4,855,527; U.S. Pat. No. 4,870,038; U.S. Pat. No. 2,477,382; EP 466,558, Jan. 15, 1992; EP 469,940, Feb. 5, 1992; FR 2,697,246, Apr. 29, 1994; SU 793,972, Jan. 7, 1981; U.S. Pat. No. 2,564,072; U.S. Pat. No. 3,196,174; U.S. Pat. No. 3,238,249; U.S. Pat. No. 3,355,484; U.S. Pat. No. 3,442,964; U.S. Pat. No. 3,492,364; U.S. Pat. No. 4,959,491; WO 88/07030, Sep. 25, 1990; U.S. Pat. No. 4,962,256, U.S. Pat. No. 5,196,624; U.S. Pat. No. 5,196,625; EP 364,012 B, Feb. 15, 1990; U.S. Pat. No. 3,312,745; U.S. Pat. No. 3,341,614; U.S. Pat. No. 3,442,965; U.S. Pat. No. 3,674,885; U.S. Pat. No. 4,447,664; U.S. Pat. No. 4,533,651; U.S. Pat. No. 4,587,374; U.S. Pat. No. 4,996,386; U.S. Pat. No. 5,210,060;

U.S. Pat. No. 5,510,306; WO 95/17961, Jul. 6, 1995; WO 95/18084; U.S. Pat. Nos. 5,087,788; 5,625,105 and 4,973,788 are useful by way of background to the invention. The manufacture of alkylbenzenesulfonate surfactants has recently been reviewed. See Vol. 56 in "Surfactant Science" series, Marcel Dekker, New York, 1996, including in particular Chapter 2 entitled "Alkylarylsulfonates: History, Manufacture, Analysis and Environmental Properties", pages 39–108 which includes 297 literature references. Documents referenced herein are incorporated in their entirety.

SUMMARY OF THE INVENTION

It has now been surprisingly found that when an alkylarylsulfonate surfactant system includes two or more isomers of crystallinity-disrupted alkylarylsulfonate surfactants, optionally containing also one or more noncrystallinity-disrupted alkylarylsulfonate surfactants, there is a surprising increase in performance over alkylarylsulfonate surfactant system which do not include the crystallinity-disrupted alkylarylsulfonate surfactant isomers.

The present invention has numerous advantages beyond one or more of the aspects identified hereinabove, including but not limited to: superior cold-water solubility, for example for cold water laundering; superior hardness tolerance; and excellent detergency. Further, the invention is expected to provide reduced build-up of old fabric softener residues from fabrics being laundered, and improved removal of lipid or greasy soils from fabrics. Benefits are expected also in non-laundry cleaning applications, such as dish cleaning. The development offers substantial expected improvements in ease of manufacture of relatively high 2-phenyl sulfonate compositions, improvements also in the ease of making and quality of the resulting detergent formulations; and attractive economic advantages.

The present invention is based on an unexpected discovery that there exist, in the middle ground between the old, highly branched, nonbiodegradable alkylbenzenesulfonates and the new linear types, certain alkylbenzenesulfonates which are both more highly performing than the latter and more biodegradable than the former.

The new alkylbenzenesulfonates are readily accessible by several of the many of known alkylbenzenesulfonate manufacturing processes. For example, the use of certain dealuminized mordenites permits their convenient manufacture.

In accordance with the present invention, a novel cleaning composition is provided. This novel cleaning composition comprises a) about 0.1% to about 99.9% by weight of said composition of an alkylarylsulfonate surfactant system comprising from about 10% to about 100% by weight of said surfactant system of two or more crystallinity-disrupted alkylarylsulfonate surfactants of formula $$(B\text{-}Ar\text{-}D)a(Mq+)b$$

wherein D is SO3-, M is a cation or cation mixture, q is the valence of said cation, a and b are numbers selected such that said composition is electroneutral; Ar is selected from benzene, toluene, and combinations thereof; and B comprises the sum of at least one primary hydrocarbyl moiety containing from 5 to 20 carbon atoms, preferably 7 to 16, more preferably 9–15, most preferably 10–14 carbon atoms and one or more crystallinity-disrupting moieties wherein said crystallinity-disrupting moieties interrupt or branch from said hydrocarbyl moiety; and wherein said alkylarylsulfonate surfactant system has crystallinity disruption to the extent that its Sodium Critical Solubility Temperature, as measured by the CST Test, is no more than about 40° C. and wherein further said alkylarylsulfonate surfactant system has at least one of the following properties:

percentage biodegradation, as measured by the modified SCAS test, that exceeds tetrapropylene benzene sulfonate; and weight ratio of nonquaternary to quaternary carbon atoms in B of at least about 5:1 (preferably at least about 10:1; more preferably at least about 100:1); and b) from about 0.00001% to about 99.9% by weight of said composition of cleaning composition adjunct ingredients, at least one of which is selected from the group consisting of: i) detersive enzymes, preferably selected from proteases, amylases, lipases, cellulases, peroxidases, and mixtures thereof; ii) organic detergent builders, preferably selected from polycarboxylate compounds, ether hydroxypolycarboxylates, substituted ammonium salts of polyacetic acids, and mixtures thereof; iii) oxygen bleaching agent, preferably selected from hydrogen peroxide, inorganic peroxohydrates, organic peroxohydrates and the organic peroxyacids, including hydrophilic and hydrophobic mono- and di-peroxyacids, and mixtures thereof; iv) bleach activators, preferably selected from TAED, NOBS, and mixtures thereof; v) transition metal bleach catalysts, preferably manganese-containing bleach catalysts; vi) oxygen transfer agents and precursors; vii) polymeric soil release agents; viii) water-soluble ethoxylated amines having clay soil removal and antiredeposition properties; ix) polymeric dispersing agents; x) polymeric dye transfer inhibiting agents; xi) alkoxylated polycarboxylates;and xii) mixtures thereof.

The cleaning composition will preferably contain at least about 0.1%, more preferably at least about 0.5%, even more preferably, still at least about 1% by weight of said composition of the surfactant system. The cleaning composition will also preferably contain no more than about 80%, more preferably no more than about 60%, even more preferably, still no more than about 40% by weight of said composition of the surfactant system.

The surfactant system will preferably contain at least about 15%, more preferably at least about 30%, even more preferably, still at least about 40% by weight of said surfactant system of two or more crystallinity disrupted alkyarylsulfonate surfactants. The surfactant system will also preferably contain no more than about 100%, more preferably no more than about 90%, even more preferably, still no more than about 80% by weight of said surfactant system of two or more crystallinity disrupted alkyarylsulfonate surfactants.

Accordingly, it is an aspect of the present invention to provide novel cleaning compositions. These, and other, aspects, features and advantages will be clear from the following detailed description and the appended claims.

All percentages, ratios and proportions herein are by weight of ingredients used to prepare the finished compositions unless otherwise specified. All temperatures are in degrees Celsius (° C.) unless otherwise specified. All documents cited herein are, in relevant part, incorporated herein by reference.

DETAILED DESCRIPTION OF THE INVENTION

The present invention relates to novel cleaning compositions. Component (a) contains from about 0.1% to about 99.9% by weight of said composition of an alkylarylsulfonate surfactant system comprising from about 10% to about 100% by weight of said surfactant system of two or more crystallinity-disrupted alkylarylsulfonate surfactants of formula (B-Ar-D)a(Mq+)b wherein D is SO3-. M is a cation or cation mixture. Preferably, M is an alkali metal, an alkaline earth metal, ammonium, substituted ammonium or mixtures thereof, more preferably sodium, potassium, magnesium, calcium or mixtures thereof. The valence of said cation, q, is preferably 1 or 2. The numbers selected such that said composition is electroneutral, a and b, are preferably 1 or 2 and 1 respectively.

Ar preferably is selected from benzene, toluene, and combinations thereof, and most preferably benzene.

B comprises the sum of at least one primary hydrocarbyl moiety containing from 5 to 20 carbon atoms and one or more crystallinity-disrupting moieties wherein said crystallinity-disrupting moieties interrupt or branch from said hydrocarbyl moiety. Preferably, B includes both odd and even chain length of the hydrocarbyl moiety. That is, it is preferred that B is not limited to being all odd or all even chain length of the hydrocarbyl moiety. The primary hydrocarbyl moiety of B has from 5 to 20, preferably 7 to 16 carbon atoms. There may be from one to three crystallinity-disrupting moieties. The crystallinity-disrupting moieties interrupt or branch from said hydrocarbyl moiety. When the crystallinity-disrupting moieties are branches they are, preferably C1–C3 alkyl, C1–C3 alkoxy, hydroxy and mixtures thereof, more preferably C1–C3 alkyl, most preferably C1–C2 alkyl, more preferably still methyl. When the crystallinity-disrupting moieties interrupt the hydrocarbyl moiety they are, preferably ether, sulfone, silicone and mixtures thereof, more preferably ether. It is preferred that the crystallinity-disrupted alkylarylsulfonate surfactants include two or more homologs. "Homologs" vary in the number of carbon atoms contained in B. "Isomers", which are described herein after in more detail, include especially those compounds having different positions of attachment of the crystallinity-disrupting moieties to B.

It is also preferred that the crystallinity-disrupted alkylarylsulfonate surfactants include at least two "isomers" selected from i) ortho-, meta- and para-isomers based on positions of attachment of substituents to Ar, when Ar is a substituted or unsubstituted benzene. This meant that B can be ortho-, meta- and para- to D, B can be ortho-, meta- and para- to a substituent on Ar other than D, D can be ortho-, meta- and para- to a substituent on Ar other than B, or any other possible alternative;

ii) positional isomers based on positions of attachment of said crystallinity-disrupting moieties to said primary hydrocarbyl moiety of B; and iii) stereoisomers based on chiral carbon atoms in B.

It is more preferred that the crystallinity-disrupted alkylarylsulfonate surfactants will include at least two isomers of type ii), most preferably at least four isomers of type ii).

Preferably, at least about 60% by weight of said surfactant system of said crystallinity-disrupted alkylarylsulfonate surfactants is in the form of isomers wherein Ar is attached to B at the first, second or third carbon atom in said primary hydrocarbyl moiety thereof, more preferably about 70% or more, most preferably about 80% or more.

An optional component of the present invention compositions is from about 0% to about 85%, by weight of the surfactant system, of one or more noncrystallinity-disrupted alkylarylsulfonate surfactants of formula (L-Ar-D)a(Mq+)b wherein D, M, q, a, b, Ar, are as defined above. L is a linear primary hydrocarbyl moiety containing from 5 to 20 carbon atoms. Preferably, L is a linear hydrocarbyl moiety having from 7 to 16 carbon atoms.

The alkylarylsulfonate surfactant system has crystallinity disruption to the extent that its Sodium Critical Solubility Temperature, as measured by the CST Test, which is defined hereinafter, is no more than about 40° C., preferably no more than about 20° C., most preferably no more than about 5° C. It is also preferable that its Calcium Critical Solubility Temperature, as measured by the CST Test, is below about 80° C., preferably no more than about 40° C., more preferably no more than about 20° C.

The alkylarylsulfonate surfactant system also has at least one of the following properties:

a) percentage biodegradation, as measured by the modified SCAS test (described herein after), that exceeds tetra propylene benzene sulphonate; or b) a weight ratio of nonquaternary to quaternary carbon atoms in B of at least about 5:1. Preferably, the weight ratio of nonquaternary to quaternary carbon atoms in B is at least about 10:1, more preferably at least about 20:1, and most preferably at least about 100:1.

More preferably, percentage biodegradation in absolute terms, is preferably at least about 60%, more preferably at least 70%, still more preferably at least 80% and most preferably at least 90%, as measured by the modified SCAS test.

The cleaning compositions of the present invention comprises a component (b) which is from about 0.00001% to about 99.9% by weight of said composition of a cleaning adjunct material. These cleaning adjunct materials, as well as other cleaning adjunct materials optionally useful herein, are described in detail hereafter.

Crystallinity Disruption

The term "crystallinity-disrupted" as defined herein means that a surfactant that is being referred to is one containing a hydrophobic moiety selected to result in a surfactant which packs less efficiently into a crystal lattice than does a reference surfactant in which the hydrophobe is a pure linear hydrocarbon chain of formula CH3(CH2)n- having length or range of chain lengths comparable to that of the surfactant being described.

Crystallinity disruption can, in general, flow from any of several modifications of the surfactant at the molecular level. Notably, a linear hydrophobe such as

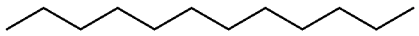

i.e., CH3(CH2)11-, which itself is "noncrystallinity disrupted" can be modified to form a crystallinity-disrupted structure in accordance with the invention by inserting various moieties such as ether moieties, silicone or sulfones into the chain as in:

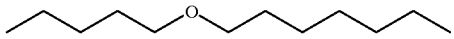

-continued

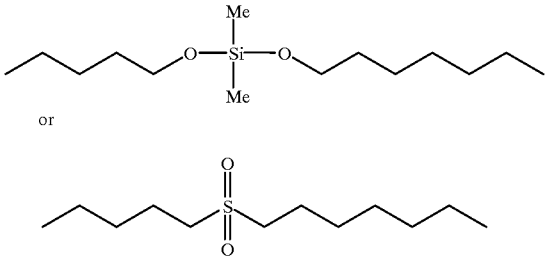

More preferably, crystallinity disruption herein takes place when one or more branchings from B are added to the structure, as in:

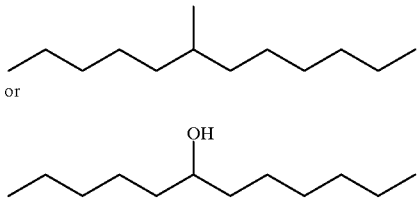

Note with respect to the surfactants herein having the formulae (B-Ar-D)a(Mq+)b and (L-Ar-D)a(Mq+)b that B represents a crystallinity-disrupted hydrophobe whereas L represents a non-crystallinity disrupted hydrophobe. Also, in alternate terms, the crystallinity-disrupted hydrophobe B comprises a primary moiety which consists of (i) all components in B other than the crystallinity-disrupting moieties; and (ii) the crystallinity-disrupting moieties.

In a preferred embodiment, B has (i) a moiety having from 7 to 16 carbon atoms and (ii) a crystallinity-disrupting moiety selected from (a) branches (or "side-chains") attached to B which may in general vary but which preferably are selected from C1–C3 alkyl, hydroxy and mixtures thereof, more preferably C1–C3 alkyl, most preferably C1–C2 alkyl, more preferably still methyl; (b) moieties which interrupt the structure of B, selected from ether, sulfone, silicone; and (c) mixtures thereof. Other crystallinity-disrupting moieties, not preferred herein, include olefin.

Alkylarylsulfonate Surfactant System

An essential component of the cleaning composition of the present invention is an alkylarylsulfonate surfactant system. The alkylarylsulfonate surfactant system comprises an essential crystallinity disrupting component.

The present invention relates to cleaning compositions comprising at least two or more such crystallinity-disrupted alkylarylsulfonate surfactants, and optionally, one or more noncrystallinity-disrupted alkylarylsulfonate surfactants. These two components are described as follows:

(1) Crystallinity-Disrupted Alkylarylsulfonate Surfactants:

The present invention cleaning compositions comprise an alkylarylsulfonate surfactant system which contains at least two or more crystallinity-disrupted alkylarylsulfonate surfactants having the formula (B-Ar-D)a(Mq+)b wherein D, B, M, q, a, b, Ar, are as hereinbefore defined. Possible crystallinity-disrupted alkylarylsulfonate surfactants include:

(a)

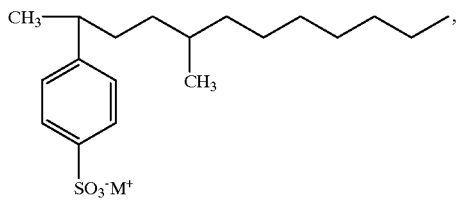

(b)

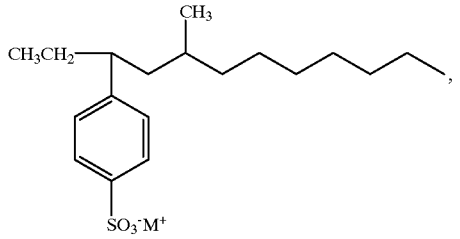

(c)

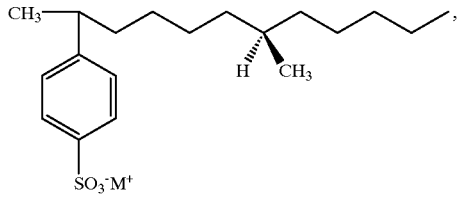

(d)

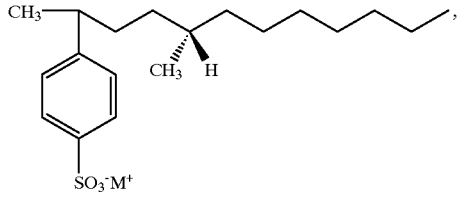

(e)

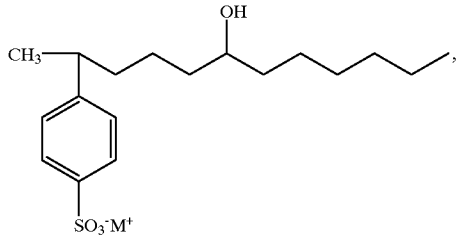

(f)

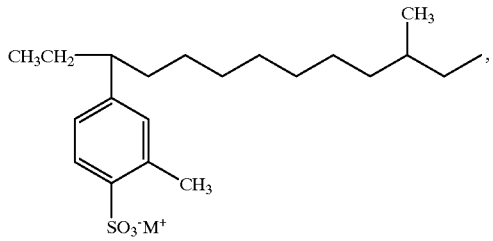

-continued (g)

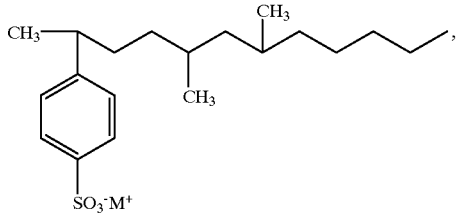

(h)

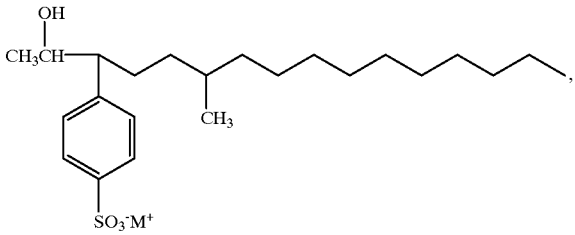

(i)

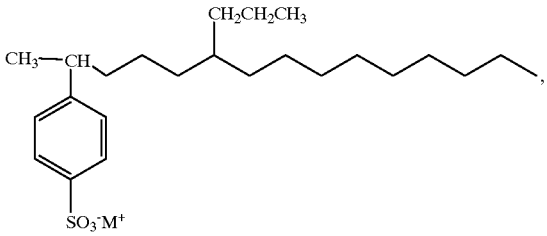

(j)

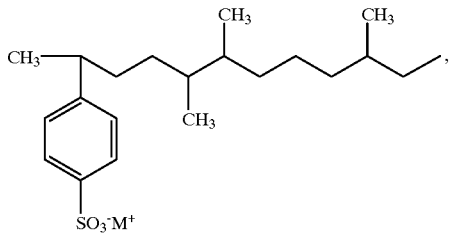

(k)

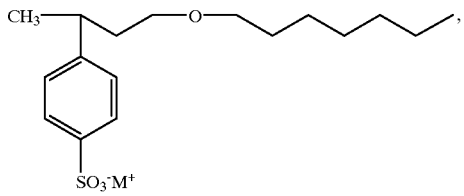

(l)

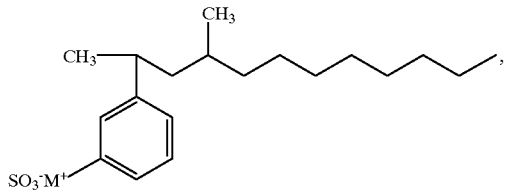

-continued (m)

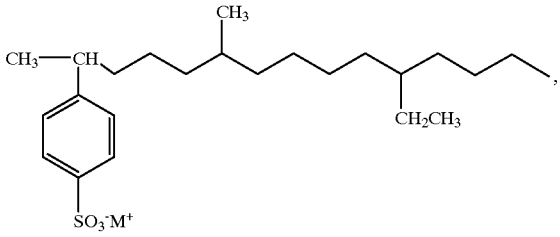

(n)

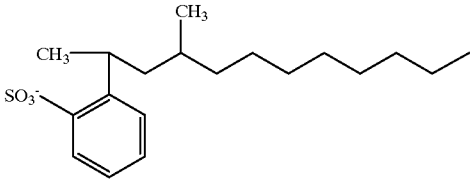

and (o)

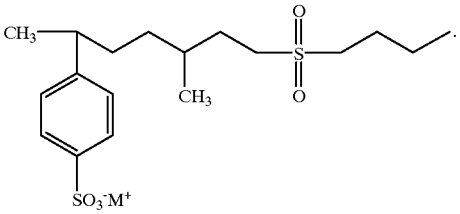

Structures (a) to (o) are only illustrative of some possible crystallinity-disrupted alkylarylsulfonate surfactants and are not intended to be limiting in the scope of the invention.

It is also preferred that the crystallinity-disrupted alkylarylsulfonate surfactants include at least two isomers selected from i) ortho-, meta- and para-isomers based on positions of attachment of substituents to Ar, when Ar is a substituted or unsubstituted benzene. This means that B can be ortho-, meta- and para- to D, B can be ortho-, meta- and para- to a substituent on Ar other than D, D can be ortho-, meta- and para- to a substituent on Ar other than B, or any other possible alternative;

ii) positional isomers based on positions of attachment of said crystallinity-disrupting moieties to said primary hydrocarbyl moiety of B; and iii) stereoisomers based on chiral carbon atoms in B.

An example of two type (ii) isomers are structures are (a) and (c). The difference is that the methyl in (a) is attached at the 5 position, but in (c) the methyl is attached to the 7 position.

An example of two type (i) isomers are structures are (l) and (n). The difference is that the sulfonate group in (l) is meta- to the hydrocarbyl moiety, but in (n) the sulfonate is ortho- to the hydrocarbyl moiety.

An example of two type (iii) isomers are structures are (c) and (d). The difference is that these isomers are stereoisomers. The chiral carbon being the 7th carbon atom in the hydrocarbyl moiety.

(2) Noncrystallinity-Disrupted Alkylarylsulfonate Surfactants:

The present inventive cleaning compositions may further optionally comprise an alkylarylsulfonate surfactant system which can contain one or more noncrystallinity-disrupted alkylarylsulfonate surfactants having the formula (L-Ar-D)a(Mq+)b wherein D, M, L, q, a, b, Ar, are as hereinbefore defined. Possible noncrystallinity-disrupted alkylarylsulfonate surfactants include standard linear alkylbenzene sulfonates, such as those which are commercially available, e.g., the so-called high 2-phenyl linear alkyl benzene sulfonates, better known as DETAL or conventional LAS available from Huntsman or Vista. These linear alkylaryl sulfonates can be added to the crystallinity-disrupted alkylarylsulfonate surfactants to provide the alkylarylsulfonate surfactant system used in the cleaning composition of the present invention. Alternatively, the noncrystallinity-disrupted alkylarylsulfonate surfactants and the crystallinity-disrupted alkylarylsulfonate surfactants are produced in the same reaction, possibly due to isomerization either before, during or after the reaction. The ratio of noncrystallinity-disrupted alkylarylsulfonate to crystallinity-disrupted alkylarylsulfonate depends on the catalyst used. Whichever catalyst is used, the surfactant system must have a Sodium Critical Solubility Temperature of no more than about 40° C. and either percentage biodegradation, as measured by the modified SCAS Test, that exceeds tetrapropylenebenzene sulfonate, preferably greater than 60%, more preferably greater than 80% or a weight ratio of nonquaternary to quaternary carbon atoms in B of at least about 5:1.

EXAMPLE 1

Crystallinity Disrupted Surfactant System Prepared via Skeletally Isomerized Linear Olefin Step (a): At Least Partially Reducing the Linearity of an Olefin (by skeletal isomerization of olefin preformed to chainlengths suitable for cleaning product detergency)

A mixture of 1-decene, 1-undecene, 1-dodecene and 1-tridecene (for example available from Chevron) at a weight ratio of 1:2:2:1 is passed over a Pt-SAPO catalyst at 220° C. and any suitable LHSV, for example 1.0. The catalyst is prepared in the manner of Example 1 of U.S. Pat. No. 5,082,956. See WO 95/21225, e.g., Example 1 and the specification thereof. The product is a skeletally isomerized lightly branched olefin having a range of chainlengths suitable for making alkylbenezenesulfonate surfactant for consumer cleaning composition incorporation. More generally the temperature in this step can be from about 200° C. to about 400° C., preferably from about 230° C. to about 320° C. The pressure is typically from about 15 psig to about 2000 psig, preferably from about 15 psig to about 1000 psig, more preferably from about 15 psig to about 600 psig. Hydrogen is a useful pressurizing gas. The space velocity (LHSV or WHSV) is suitably from about 0.05 to about 20. Low pressure and low hourly space velocity provide improved selectivity, more isomerization and less cracking. Distill to remove any volatiles boiling at up to 40° C./10 mmHg.

Step (b): Alkylating the Product of Step (a) Using an Aromatic Hydrocarbon

To a glass autoclave liner is added 1 mole equivalent of the lightly branched olefin mixture produced in step (a), 20 mole equivalents of benzene and 20 wt. % based on the olefin mixture of a shape selective zeolite catalyst (acidic mordenite catalyst Zeocat™ FM-8/25H). The glass liner is sealed inside a stainless steel rocking autoclave. The autoclave is purged twice with 250 psig N2, and then charged to 1000 psig N2. With mixing, the mixture is heated to 170–190° C. for 14–15 hours at which time it is then cooled and removed from the autoclave. The reaction mixture is filtered to remove catalyst and is concentrated by distilling off unreacted starting-materials and/or impurities (e.g., benzene, olefin, paraffin, trace materials, with useful materials being recycled if desired) to obtain a clear near-colorless liquid product. The product can then be formed into a desirable crystallinity-disrupted surfactant system which can, as an option, be shipped to a remote manufacturing facility where the additional steps of sulfonation and incorporation into consumer cleaning compositions can be accomplished.

Step (c): Sulfonating the Product of Step (b)

The product of step (b) is sulfonated with an equivalent of chlorosulfonic acid using methylene chloride as solvent. The methylene chloride is distilled away.

Step (d): Neutralizing the Product of Step (c)

The product of step (c) is neutralized with sodium methoxide in methanol and the methanol evaporated to give a crystallinity-disrupted surfactant system.

EXAMPLE 2

Crystallinity Disrupted Surfactant System Prepared via Skeletally Isomerized Linear Olefin The procedure of Example 1 is repeated with the exception that the sulfonating step, (c), uses sulfur trioxide (without methylene chloride solvent) as sulfonating agent. Details of sulfonation using a suitable air/sulfur trioxide mixture are provided in U.S. Pat. No. 3,427,342, Chemithon. Moreover, step (d) uses sodium hydroxide in place of sodium methoxide for neutralization.

EXAMPLE 3

Crystallinity Disrupted Surfactant System Prepared via Skeletally Isomerized Linear Olefin Step (a): At Least Partially Reducing the Linearity of an Olefin A lightly branched olefin mixture is prepared by passing a mixture of C11, C12 and C13 mono olefins in the weight ratio of 1:3:1 over H-ferrierite catalyst at 430° C. The method and catalyst of U.S. Pat. No. 5,510,306 can be used for this step. Distil to remove any volatiles boiling at up to 40° C./10 mmHg.

Step (b): Alkylatinp the Product of Step (a) Using an Aromatic Hydrocarbon

To a glass autoclave liner is added 1 mole equivalent of the lightly branched olefin mixture of step (a), 20 mole equivalents of benzene and 20 wt. %, based on the olefin mixture, of a shape selective zeolite catalyst (acidic mordenite catalyst Zeocat™ FM-8/25H). The glass liner is sealed inside a stainless steel, rocking autoclave. The autoclave is purged twice with 250 psig N2, and then charged to 1000 psig N2. With mixing, the mixture is heated to 170–190° C. overnight for 14–15 hours at which time it is then cooled and removed from the autoclave. The reaction mixture is filtered to remove catalyst. Benzene is distilled and recycled, volatile impurities also being removed. A clear colorless or nearly colorless liquid product is obtained.

Step (c): Sulfonating the Product of Step (b)

The product of step (b) is sulfonated with an equivalent of chlorosulfonic acid using methylene chloride as solvent. The methylene chloride is distilled away.

Step (d): Neutralizing the Product of Step (c)

The product of step (c) is neutralized with sodium methoxide in methanol and the methanol evaporated to give a crystallinity-disrupted surfactant system, sodium salt mixture.

EXAMPLE 4

Crystallinity Disrupted Surfactant System Prepared via Skeletal Isomerization of Paraffin Step (a i)

A mixture of n-undecane, n-dodecane, n-tridecane, 1:3:1 wt., is isomerized over Pt-SAPO-11 for a conversion better than 90% at a temperature of about 300–340° C., at 1000 psig under hydrogen gas, with a weight hourly space velocity in the range 2–3 and 30 moles H2/mole hydrocarbon. More detail of such an isomerization is given by S. J. Miller in Microporous Materials, Vol. 2., (1994), 439–449. In further examples the linear starting paraffin mixture can be the same as used in conventional LAB manufacture. Distil to remove any volatiles boiling at up to 40° C./10 mmHg.

Step (a ii)

The paraffin of step (a i) can be dehydrogenated using conventional methods. See, for example, U.S. Pat. No. 5,012,021, Apr. 30, 1991 or U.S. Pat. No. 3,562,797, Feb. 9, 1971. Suitable dehydrogenation catalyst is any of the catalysts disclosed in U.S. Pat. Nos. 3,274,287; 3,315,007; 3,315,008; 3,745,112; 4,430,517; and 3,562,797. For purposes of the present example, clehydrogenation is in accordance with U.S. Pat. No. 3,562,797. The catalyst is zeolite A. The dehydrogenation is conducted in the vapor phase in presence of oxygen (paraffin:dioxygen 1:1 molar). The temperature is in range 450 deg. C–550 deg. C. Ratio of grams of catalyst to moles of total feed per hour is 3.9.

Step (b): Alkylating the Product of Step (a) Using an Aromatic Hydrocarbon

To a glass autoclave liner is added 1 mole equivalent of the mixture of step (a), 5 mole equivalents of benzene and 20 wt. %, based on the olefin mixture, of a shape selective zeolite catalyst (acidic mordenite catalyst Zeocat™ FM-8/25H). The glass liner is sealed inside a stainless steel, rocking autoclave. The autoclave is purged twice with 250 psig N2, and then charged to 1000 psig N2. With mixing, the mixture is heated to 170–190° C. overnight for 14–15 hours at which time it is then cooled and removed from the autoclave. The reaction mixture is filtered to remove catalyst. Benzene and any unreacted paraffins are distilled and recycled. A clear colorless or nearly colorless liquid product is obtained.

Step (c): Sulfonating the Product of Step (b)

The product of step (b) is sulfonated with sulfur trioxide/air using no solvent. See U.S. Pat. No. 3,427,342. The molar ratio of sulfur trioxide to alkylbenzene is from about 1.05:1 to about 1.15:1. The reaction stream is cooled and separated from excess sulfur trioxide.

Step (d): Neutralizing the Product of Step (c)

The product of step (c) is neutralized with a slight excess of sodium hydroxide to give a crystallinity-disrupted surfactant system.

EXAMPLE 5

Crystallinity Disrupted Surfactant System Prepared via Specific Tertiary Alcohol Mixture from a Grignard Reaction A mixture of 5-methyl-5-undecanol, 6-methyl-6-dodecanol and 7-methyl-7-tridecanol is prepared via the following Grignard reaction. A mixture of 28 g of 2-hexanone, 28 g of 2-heptanone, 14 g of 2-octanone and 100 g of diethyl ether are added to an addition funnel. The ketone mixture is then added dropwise over a period of 1.75 hours to a nitrogen blanketed stirred three neck round bottom flask, fitted with a reflux condenser and containing 350 mL of 2.0 M hexylmagnesium bromide in diethyl ether and an additional 100 mL of diethyl ether. After the addition is complete, the reaction mixture is stirred an additional 1 hour at 20° C. The reaction mixture is then added to 600 g of a mixture of ice and water with stirring. To this mixture is added 228.6 g of 30% sulfuric acid solution. The resulting two liquid phases are added to a separatory funnel. The aqueous layer is drained and the remaining ether layer is washed twice with 600 mL of water. The ether layer is then evaporated under vacuum to yield 115.45 g of the desired alcohol mixture. A 100 g sample of the light yellow alcohol mixture is added to a glass autoclave liner along with 300 mL of benzene and 20 g of a shape selective zeolite catalyst (acidic mordenite catalyst Zeocat™ FM-8/25H). The glass liner is sealed inside a stainless steel, rocking autoclave. The autoclave is purged twice with 250 psig N2, and then charged to 1000 psig N2. With mixing, the mixture is heated to 170° C. overnight for 14–15 hours at which time it is then cooled and removed from the autoclave. The reaction mixture is filtered to remove catalyst and concentrated by distilling off the benzene which is dried and recycled. A clear colorless or nearly colorless lightly branched olefin mixture is obtained.

50 g of the lightly branched olefin mixture provided by dehydrating the Grignard alcohol mixture as above is added to a glass autoclave liner along with 150 mL of benzene and 10 g of a shape selective zeolite catalyst (acidic mordenite catalyst Zeocat™ FM-8/25H). The glass liner is sealed inside a stainless steel, rocking autoclave. The autoclave is purged twice with 250 psig N2, and then charged to 1000 psig N2. With mixing, the mixture is heated to 195° C. overnight for 14–15 hours at which time it is then cooled and removed from the autoclave. The reaction mixture is filtered to remove catalyst and concentrated by distilling off the benzene which is dried and recycled. A clear colorless or nearly colorless liquid product is obtained. The product is distilled under vacuum (1–5 mm of Hg) and the fraction from 95° C.–135° C. is retained.

The retained fraction, i.e., the clear colorless or nearly colorless liquid product, is then sulfonated with a molar equivalent of SO3 and the resulting product is neutralized with sodium methoxide in methanol and the methanol evaporated to give a crystallinity-disrupted surfactant system.

Critical Solubility Temperature Test, or CST Test

The Critical Solubility Temperature Test is a measure of the Critical Solubility Temperature of a surfactant system. The Critical Solubility Temperature, simply stated, is a measure of the temperature a surfactant system at which solubility suddenly and dramatically increases. This temperature is becoming more and more significant with today's trends towards lower and lower wash temperatures. It has been surprisingly found that Critical Solubility Temperature of the alkylarylsulfonate surfactant system of the present invention can be lowered by the number and type of crystallinity-disrupted alkylarylsulfonate surfactants present in the alkylarylsulfonate surfactant system.

The Critical Solubility Temperature is measured in the following manner:

All glassware used is cleaned and dried thoroughly. All temperatures are measured using a calibrated mercury thermometer. The sample weights used are based on the anhydrous form of the solid surfactant or surfactant mixture.

A) Sodium Critical Solubility Temperature—An amount of 99 g of de-ionized water is weighed into a clean, dry beaker equipped with a magnetic stirrer. The beaker is then placed in an ice-water bath until the de-ionized water has been cooled to 0° C. A 1.0 g sample of the solid sodium salt of the surfactant or surfactant mixture for which the Sodium Critical Solubility Temperature is to be measured is then added. The resulting heterogeneous solution is stirred for one hour. If the surfactant sample dissolves within one hour and without any heating to give a clear homogenous solution, the Sodium Critical Solubility Temperature is recorded as ≦0° C. If the surfactant sample does not dissolve within one hour to give a clear homogenous solution, the heterogeneous solution is slowly heated with stirring at a rate of 0.1° C. per minute. The temperature at which the surfactant sample dissolves to give a clear homogenous solution is recorded as the Sodium Critical Solubility Temperature.

B) Calcium Critical Solubility Temperature—An amount of 99 g of de ionized water is weighed into a clean, dry beaker equipped with a magnetic stirrer. The beaker is then placed in an ice-water bath until the de ionized water has been cooled to 0° C. A 1.0 g sample of the solid calcium salt of the surfactant or surfactant mixture for which the Calcium Critical Solubility Temperature is to be measured is then added. The resulting heterogeneous solution is stirred for one hour. If the surfactant sample dissolves within one hour and without any heating to give a clear homogenous solution, the Calcium Critical Solubility Temperature is recorded as ≦0° C. If the surfactant sample does not dissolve within one hour to give a clear homogenous solution, the heterogeneous solution is slowly heated with stirring at a rate of 0.1° C. per minute. The temperature at which the surfactant sample dissolves to give a clear homogenous solution is recorded as the Calcium Critical Solubility Temperature.

Sodium salts of surfactant mixtures here-in are the most common form in which the surfactant mixtures are used. Conversion to calcium salts by simple metathesis e.g., in dilute solution or assisted by a suitable organic solvent, is well known.

Modified SCAS Test

This method is an adaptation of the Soap and Detergent Association semi-continuous activated sludge (SCAS) procedure for assessing the primary biodegradation of alkylbenzene sulphonate. The method involves exposure of the chemical to relatively high concentrations of micro-organisms over a long time period (possibly several months). The viability of the micro-organisms is maintained over this period by daily addition of a settled sewage feed. This modified test is also the standard OECD test for inherent biodegradability or 302A. This test was adopted by the OECD on May 12, 1981. Details on the "unmodified" SCAS test can be found in "A procedure and Standards for the Determination of the Biodegradability of Alkyl Benzene Sulphonate and Linear Alkylate Sulphonate", Journal of the American Oil Chemists' Society, Vol. 42, p. 986 (1965).

The results obtained with the test surfactant or surfactant system, indicate that it has a high biodegradation potential, and for this reason it is most useful as a test of inherent biodegradability.

The aeration units used are identical to those disclosed in the "unmodified" SCAS test. That is, a Plexiglas tubing 83 mm (3¼ in.) I.D.(internal diameter) Taper the lower end 30° from the vertical to a 13 mm (½ in.) hemisphere at the bottom. 25.4 mm (1 in.) above the joint of the vertical and tapered wall, locate the bottom of a 25.4 mm (1 in.) diameter opening for insertion of the air delivery tube. The total length of the aeration chamber should be at least 600 mm (24 in.). An optional draining hole may be located at the 500 ml level to facilitate sampling. Units are left open to the atmosphere. The air supplied to the aeration units from a small laboratory scale air compressor. The air is filtered through glass wool or any other suitable medium to remove contamination, oil, etc. The air is also presaturated with water to reduce evaporation losses from the unit. The air is delivered at a rate of 500 ml/minute (1 ft3/hour). The air is delivered via an 8 mm O.D. (outside diameter), 2 mm I.D. capillary tube. The end of the capillary tube is located 7 mm (¼ in.) from the bottom of the aeration chamber.

Modified SCAS Test—The aeration units are cleaned and fixed in a suitable support.

This procedure is conducted at 25°+3° C. Stock solutions of the test surfactant or surfactant system are prepared: the concentration normally required is 400 mg/litre as organic carbon normally gives a test surfactant or surfactant system concentration of 20 mg/litre carbon at the start of each biodegradation cycle if no biodegradation is occurring.

A sample of mixed liquor from an activated sludge plant treating predominantly domestic sewage is obtained. Each aeration unit is filled with 150 ml of mixed liquor and the aeration is started. After 23 hours, aeration is stopped, and the sludge is allowed to settle for 45 minutes. 100 ml of the supernatant liquor is withdrawn. A sample of the settled domestic sewage is obtained immediately before use, and 100 ml are added to the sludge remaining in each aeration unit. Aeration is started anew. At this stage no test materials are added, and the units are fed daily with domestic sewage only until a clear supernatant liquor is obtained on settling. This usually takes up to two weeks, by which time the dissolved organic carbon in the supernatant liquor at the end of each aeration cycle should be less than 12 mg/litre.

At the end of this period the individual settled sludges are mixed, and 50 ml of the resulting composite sludge are added to each unit.

100 ml of settled sewage are added to the aeration units which will be the control units. Add 95 ml of settled sewage plus 5 ml of the appropriate test surfactant or surfactant system stock solution (400 mg/l) to the aeration units which will be the control units. Aeration is started again and continued for 23 hours. The sludge is then allowed to settle for 45 minutes and the supernatant drawn off and analyzed for dissolved organic carbon content. The carbon content (D.O.C.) is analyzed using a SHIMADZU Model TOC-5000 TOC analyzer. This fill and draw procedure is repeated daily throughout the test. Before settling it may be necessary to clean the walls of the units to prevent the accumulation of solids above the level of the liquid. A separate scraper or brush is used for each unit to prevent cross contamination.

Ideally the dissolve organic carbon in the supernatant liquors is determined daily, although less frequent analysis is permissible. Before analysis the liquors are filtered through washed 0.45 micron membrane filters and centrifuged. Temperature of the sample must not exceed 40° C. while it is in the centrifuge.

The dissolved organic carbon results in supernatant liquors of the test aeration units and the control aeration units are plotted against time. As biodegradation is achieved the level found in the test aeration units will approach that found in the control aeration units. Once the difference between the two levels is found to be constant over three consecutive measurements, three further measurements are made and the percentage biodegradation of the test surfactant or surfactant system is calculated by the following equation:

$$\%\ \text{biodegradation} = \frac{100[O_T - (O_l - O_c)]}{O_T};$$

where

OT=concentration of test surfactant or surfactant system as organic carbon added to the settled sewage at the start of the aeration period.

Ol=concentration of dissolved organic carbon found in the supernatant liquor of the test aeration units at the end of the aeration period.

Oc=concentration of dissolved organic carbon found in the supernatant liquor of the control aeration units.

The level of biodegradation is therefore the percentage elimination of organic carbon.

This modified test provides the following data (as reported on page 7 of the standard OECD test for inherent biodegradability, or 302A) for tetra propylene benzene sulphonate ("TPBS"; see "Surfactant Science Series", Vol. 56, Marcel Dekker, N.Y., 1996, page 43):

| Test surfactant or surfactant system | OT (mg/l) | Ol − Oc (mg/l) | Percentage biodegradation |
|---|---|---|---|
| TPBS | 17.3 | 8.4 | 51.4 |

Cleaning Compositions

The cleaning compositions of the present invention encompass a wide range of consumer cleaning product compositions including powders, liquids, granules, gels, pastes, tablets, pouches, bars, types delivered in dual-compartment containers, spray or foam detergents and other homogeneous or multiphasic consumer cleaning product forms. They can be used or applied by hand and/or can be applied in unitary or freely alterable dosage, or by automatic dispensing means, or are useful in appliances such as washing-machines or dishwashers or can be used in institutional cleaning contexts, including for example, for personal cleansing in public facilities, for bottle washing, for surgical instrument cleaning or for cleaning electronic components. They can have a wide range of pH, for example from about 2 to about 12 or higher, and they can have a wide range of alkalinity reserve which can include very high alkalinity reserves as in uses such as drain unblocking in which tens of grams of NaOH equivalent can be present per 100 grams of formulation, ranging through the 1–10 grams of NaOH equivalent and the mild or low-alkalinity ranges of liquid hand cleaners, down to the acid side such as in acidic hard-surface cleaners. Both high-foaming and low-foaming detergent types are encompassed.

Consumer product cleaning compositions are described in the "Surfactant Science Series", Marcel Dekker, New York, Volumes 1–67 and higher. Liquid compositions in particular are described in detail in the Volume 67, "Liquid Detergents", Ed. Kuo-Yann Lai, 1997, ISBN 0-8247-9391-9 incorporated herein by reference. More classical formulations, especially granular types, are described in "Detergent Manufacture including Zeolite Builders and Other New Materials", Ed. M. Sittig, Noyes Data Corporation, 1979 incorporated by reference. See also Kirk Othmer's Encyclopedia of Chemical Technology.

Consumer product cleaning compositions herein nonlimitingly include:

Light Duty Liquid Detergents (LDL): these compositions include LDL compositions having surfactancy improving magnesium ions (see for example WO 97/00930 A; GB 2,292,562 A; U.S. Pat. No. 5,376,310; U.S. Pat. No. 5,269,974; U.S. Pat. No. 5,230,823; U.S. Pat. No. 4,923,635; U.S. Pat. No. 4,681,704; U.S. Pat. No. 4,316,824; U.S. Pat. No. 4,133,779) and/or organic diamines and/or various foam stabilizers and/or foam boosters such as amine oxides (see for example U.S. Pat. No. 4,133,779) and/or skin feel modifiers of surfactant, emollient and/or enzymatic types including proteases; and/or antimicrobial agents; more comprehensive patent listings are given in Surfactant Science Series, Vol. 67, pages 240–248.

Heavy Duty Liquid Detergents (HDL): these compositions include both the so-called "structured" or multi-phase (see for example U.S. Pat. No. 4,452,717; U.S. Pat. No. 4,526,709; U.S. Pat. No. 4,530,780; U.S. Pat. No. 4,618,446; U.S. Pat. No. 4,793,943; U.S. Pat. No. 4,659,497; U.S. Pat. No. 4,871,467; U.S. Pat. No. 4,891,147; U.S. Pat. No. 5,006,273; U.S. Pat. No. 5,021,195; U.S. Pat. No. 5,147,576; U.S. Pat. No. 5,160,655) and "non-structured" or isotropic liquid types and can in general be aqueous or nonaqueous (see, for example EP 738,778 A; WO 97/00937 A; WO 97/00936 A; EP 752,466 A; DE 19623623 A; WO 96/10073 A; WO 96/10072 A; U.S. Pat. No. 4,647,393; U.S. Pat. No. 4,648,983; U.S. Pat. No. 4,655,954; U.S. Pat. No. 4,661,280; EP 225,654; U.S. Pat. No. 4,690,771; U.S. Pat. No. 4,744,916; U.S. Pat. No. 4,753,750; U.S. Pat. No. 4,950,424; U.S. Pat. No. 5,004,556; U.S. Pat. No. 5,102,574; WO 94/23009; and can be with bleach (see for example U.S. Pat. No. 4,470,919; U.S. Pat. No. 5,250,212; EP 564,250; U.S. Pat. No. 5,264,143; U.S. Pat. No. 5,275,753; U.S. Pat. No. 5,288,746; WO 94/11483; EP 598,170; EP 598,973; EP 619,368; U.S. Pat. No. 5,431,848; U.S. Pat. No. 5,445,756) and/or enzymes (see for example U.S. Pat. No. 3,944,470; U.S. Pat. No. 4,111,855; U.S. Pat. No. 4,261,868; U.S. Pat. No. 4,287,082; U.S. Pat. No. 4,305,837; U.S. Pat. No. 4,404,115; U.S. Pat. No. 4,462,922; U.S. Pat. No. 4,529,5225; U.S. Pat. No. 4,537,706; U.S. Pat. No. 4,537,707; U.S. Pat. No. 4,670,179; U.S. Pat. No. 4,842,758; U.S. Pat. No. 4,900,475; U.S. Pat. No. 4,908,150; U.S. Pat. No. 5,082,585; U.S. Pat. No. 5,156,773; WO 92/19709; EP 583,534; EP 583,535; EP 583,536; WO 94/04542; U.S. Pat. No. 5,269,960; EP 633,311; U.S. Pat. No. 5,422,030; U.S. Pat. No. 5,431,842; U.S. Pat. No. 5,442,100) or without bleach and/or enzymes. Other patents relating to heavy-duty liquid detergents are tabulated or listed in Surfactant Science Series, Vol. 67, pages 309–324.

Heavy Duty Granular Detergents (HDG): these compositions include both the so-called "compact" or agglomerated or otherwise non-spray-dried, as well as the so-called "fluffy" or spray-dried types. Included are both phosphated and nonphosphated types. Such detergents can include the more common anionic-surfactant based types or can be the so-called "high-nonionic surfactant" types in which commonly the nonionic surfactant is held in or on an absorbent such as zeolites or other porous inorganic salts. Manufacture of HDG's is, for example, disclosed in EP 753,571 A; WO 96/38531 A; U.S. Pat. No. 5,576,285; U.S. Pat. No. 5,573,697; WO 96/34082 A; U.S. Pat. No. 5,569,645; EP 739,977 A; U.S. Pat. No. 5,565,422; EP 737,739 A; WO 96/27655 A; U.S. Pat. No. 5,554,587; WO 96/25482 A; WO 96/23048 A; WO 96/22352 A; EP 709,449 A; WO 96/09370 A; U.S. Pat. No. 5,496,487; U.S. Pat. No. 5,489,392 and EP 694,608 A.

"Softergents" (STW): these compositions include the various granular or liquid (see for example EP 753,569 A; U.S. Pat. No. 4,140,641; U.S. Pat. No. 4,639,321; U.S. Pat.

No. 4,751,008; EP 315,126; U.S. Pat. No. 4,844,821; U.S. Pat. No. 4,844,824; U.S. Pat. No. 4,873,001; U.S. Pat. No. 4,911,852; U.S. Pat. No. 5,017,296; EP 422,787) softening-through-the wash types of product and in general can have organic (e.g., quaternary) or inorganic (e.g., clay) softeners.

Hard Surface Cleaners (HSC): these compositions include all-purpose cleaners such as cream cleansers and liquid all-purpose cleaners; spray all-purpose cleaners including glass and tile cleaners and bleach spray cleaners; and bathroom cleaners including mildew-removing, bleach-containing, antimicrobial, acidic, neutral and basic types. See, for example EP 743,280 A; EP 743,279 A. Acidic cleaners include those of WO 96/34938 A.

Bar Soaps (BS&HW): these compositions include personal cleansing bars as well as so-called laundry bars (see, for example WO 96/35772 A); including both the syndet and soap-based types and types with softener (see U.S. Pat. No. 5,500,137 or WO 96/01889 A); such compositions can include those made by common soap-making techniques such as plodding and/or more unconventional techniques such as casting, absorption of surfactant into a porous support, or the like. Other bar soaps (see for example BR 9502668; WO 96/04361 A; WO 96/04360 A; U.S. Pat. No. 5,540,852) are also included. Other handwash detergents include those such as are described in GB 2,292,155 A and WO 96/01306 A.

Shampoos and Conditioners (S&C): (see, for example WO 96/37594 A; WO 96/17917 A; WO 96/17590 A; WO 96/17591 A). Such compositions in general include both simple shampoos and the so-called "two-in-one" or with conditioner" types.

Liquid Soaps (LS): these compositions include both the so-called "antibacterial" and conventional types, as well as those with or without skin conditioners and include types suitable for use in pump dispensers, and by other means such as wall-held devices used institutionally.

Fabric Softeners (FS): these compositions include both the conventional liquid and liquid concentrate types (see, for example EP 754,749 A; WO 96/21715 A; U.S. Pat. No. 5,531,910; EP 705,900 A; U.S. Pat. No. 5,500,138) as well as dryer-added or substrate-supported types (see, for example U.S. Pat. No. 5,562,847; U.S. Pat. No. 5,559,088; EP 704,522 A). Other fabric softeners include solids (see, for example U.S. Pat. No. 5,505,866).

Special Purpose Cleaners (SPC) including home dry cleaning systems (see for example WO 96/30583 A; WO 96/30472 A; WO 96/30471 A; U.S. Pat. No. 5,547,476; WO 96/37652 A); bleach pretreatment products for laundry (see EP 751,210 A); fabric care pretreatment products (see for example EP 752,469 A); liquid fine fabric detergent types, especially the high-foaming variety; rinse-aids for dish-washing; liquid bleaches including both chlorine type and oxygen bleach type, and disinfecting agents, mouthwashes, denture cleaners (see, for example WO 96/19563 A; WO 96/19562 A), car or carpet cleaners or shampoos (see, for example EP 751,213 A; WO 96/15308 A), hair rinses, shower gels, foam baths and personal care cleaners (see, for example WO 96/37595 A; WO 96/37592 A; WO 96/37591 A; WO 96/37589 A; WO 96/37588 A; GB 2,297,975 A; GB 2,297,762 A; GB 2,297,761 A; WO 96/17916 A; WO 96/12468 A) and metal cleaners; as well as cleaning auxiliaries such as bleach additives and "stain-stick" or other pre-treat types including special foam type cleaners (see, for example EP 753,560 A; EP 753,559 A; EP 753,558 A; EP 753,557 A; EP 753,556 A) and anti-sunfade treatments (see WO 96/03486 A; WO 96/03481 A; WO 96/03369 A) are also encompassed. Detergents with enduring perfume (see for example U.S. Pat. No. 5,500,154; WO 96/02490) are increasingly popular.

Laundry or Cleaning Adjunct Materials and Methods:

The cleaning compositions of the present invention contain from about 0.00001% to about 99.9% by weight of at least one cleaning adjunct material selected from the group consisting of: i) detersive enzymes, preferably selected from proteases, amylases, lipases, cellulases, peroxidases, and mixtures thereof, ii) organic detergent builders, preferably selected from polycarboxylate compounds, ether hydroxypolycarboxylates, substituted ammonium salts of polyacetic acids, and mixtures thereof; iii) oxygen bleaching agent, preferably selected from hydrogen peroxide, inorganic peroxohydrates, organic peroxohydrates and the organic peroxyacids, including hydrophilic and hydrophobic mono- and di-peroxyacids, and mixtures thereof, iv) bleach activators, preferably selected from TAED, NOBS, and mixtures thereof; v) transition metal bleach catalysts, preferably manganese-containing bleach catalysts; vi) Oxygen transfer agents and precursors; vii) polymeric soil release agents; viii) water-soluble ethoxylated amines having clay soil removal and antiredeposition properties; ix) polymeric dispersing agents; x) polymeric dye transfer inhibiting agents; xi) alkoxylated polycarboxylates; and xii) mixtures thereof.

In general, a laundry or cleaning adjunct is any material required to transform a composition containing only the minimum essential ingredients into a composition useful for laundry or cleaning purposes. In preferred embodiments, laundry or cleaning adjuncts are easily recognizable to those of skill in the art as being absolutely characteristic of laundry or cleaning products, especially of laundry or cleaning products intended for direct use by a consumer in a domestic environment.

The precise nature of these additional components, and levels of incorporation thereof, will depend on the physical form of the composition and the nature of the cleaning operation for which it is to be used.

Preferably, the adjunct ingredients if used with bleach should have good stability therewith. Certain preferred detergent compositions herein should be boron-free and/or phosphate-free as required by legislation. Levels of adjuncts are from about 0.00001% to about 99.9%, typically from about 70% to about 95%, by weight of the compositions. Use levels of the overall compositions can vary widely depending on the intended application, ranging for example from a few ppm in solution to so-called "direct application" of the neat cleaning composition to the surface to be cleaned.

Common adjuncts include builders, surfactants, enzymes, polymers, bleaches, bleach activators, catalytic materials and the like excluding any materials already defined hereinabove as part of the essential component of the inventive compositions. Other adjuncts herein can include diverse active ingredients or specialized materials such as dispersant polymers (e.g., from BASF Corp. or Rohm & Haas), color speckles, silvercare, anti-tarnish and/or anti-corrosion agents, dyes, fillers, germicides, alkalinity sources, hydrotropes, anti-oxidants, enzyme stabilizing agents, pro-perfumes, perfumes, solubilizing agents, carriers, processing aids, pigments, and, for liquid formulations, solvents, as described in detail hereinafter.

Quite typically, laundry or cleaning compositions herein such as laundry detergents, laundry detergent additives, hard surface cleaners, synthetic and soap-based laundry bars, fabric softeners and fabric treatment liquids, solids and treatment articles of all kinds will require several adjuncts, though certain simply formulated products, such as bleach additives, may require only, for example, a oxygen bleaching agent and a surfactant as described herein. A comprehensive list of suitable laundry or cleaning adjunct materials and methods can be found in U.S. Provisional Patent application No. 60/053,319 filed Jul. 21, 1997 and assigned to Procter & Gamble.

Detersive Surfactants

The instant compositions desirably include a detersive surfactant. Detersive surfactants are extensively illustrated in U.S. Pat. No. 3,929,678, Dec. 30, 1975 Laughlin, et al, and U.S. Pat. No. 4,259,217, Mar. 31, 1981, Murphy; in the series "Surfactant Science", Marcel Dekker, Inc., New York and Basel; in "Handbook of Surfactants", M. R. Porter, Chapman and Hall, 2nd Ed., 1994; in "Surfactants in Consumer Products", Ed. J. Falbe, Springer-Verlag, 1987; and in numerous detergent-related patents assigned to Procter & Gamble and other detergent and consumer product manufacturers.

The detersive surfactant herein therefore includes anionic, nonionic, zwitterionic or amphoteric types of surfactant known for use as cleaning agents in textile laundering, but does not include completely foam-free or completely insoluble surfactants (though these may be used as optional adjuncts). Examples of the type of surfactant considered optional for the present purposes are relatively uncommon as compared with cleaning surfactants but include, for example, the common fabric softener materials such as dioctadecyldimethylammonium chloride.

In more detail, detersive surfactants useful herein, typically at levels from about 1% to about 55%, by weight, suitably include: (1) conventional alkylbenzenesulfonates; (2) olefin sulfonates, including α-olefin sulfonates and sulfonates derived from fatty acids and fatty esters; (3) alkyl or alkenyl sulfosuccinates, including the diester and half-ester types as well as sulfosuccinamates and other sulfonate/carboxylate surfactant types such as the sulfosuccinates derived from ethoxylated alcohols and alkanolamides; (4) paraffin or alkane sulfonate- and alkyl or alkenyl carboxysulfonate-types including the product of adding bisulfite to alpha olefins; (5) alkylnaphthalenesulfonates; (6) alkyl isethionates and alkoxypropanesulfonates, as well as fatty isethionate esters, fatty esters of ethoxylated isethionate and other ester sulfonates such as the ester of 3-hydroxypropanesulfonate or AVANEL S types; (7) benzene, cumene, toluene, xylene, and naphthalene sulfonates, useful especially for their hydrotroping properties; (8) alkyl ether sulfonates; (9) alkyl amide sulfonates; (10) α-sulfo fatty acid salts or esters and internal sulfo fatty acid esters; (11) alkylglycerylsulfonates; (12) ligninsulfonates; (13) petroleum sulfonates, sometimes known as heavy alkylate sulfonates; (14) diphenyl oxide disulfonates; (15) linear or branched alkylsulfates or alkenyl sulfates; (16) alkyl or alkylphenol alkoxylate sulfates and the corresponding polyalkoxylates, sometimes known as alkyl ether sulfates, as well as the alkenylalkoxysulfates or alkenylpolyalkoxy sulfates; (17) alkyl amide sulfates or alkenyl amide sulfates, including sulfated alkanolamides and their alkoxylates and polyalkoxylates; (18) sulfated oils, sulfated alkylglycerides, sulfated alkylpolyglycosides or sulfated sugar-derived surfactants; (19) alkyl alkoxycarboxylates and alkylpolyalkoxycarboxylates, including galacturonic acid salts; (20) alkyl ester carboxylates and alkenyl ester carboxylates; (21) alkyl or alkenyl carboxylates, especially conventional soaps and α,ω-dicarboxylates, including also the alkyl- and alkenylsuccinates; (22) alkyl or alkenyl amide alkoxy- and polyalkoxy-carboxylates; (23) alkyl and alkenyl amidocarboxylate surfactant types, including the sarcosinates, taurides, glycinates, aminopropionates and iminopropionates; (24) amide soaps, sometimes referred to as fatty acid cyanamides; (25) alkylpolyaminocarboxylates; (26) phosphorus-based surfactants, including alkyl or alkenyl phosphate esters, alkyl ether phosphates including their alkoxylated derivatives, phosphatidic acid salts, alkyl phosphonic acid salts, alkyl di(polyoxyalkylene alkanol) phosphates, amphoteric phosphates such as lecithins; and phosphate/carboxylate, phosphate/sulfate and phosphate/sulfonate types; (27) Pluronic- and Tetronic-type nonionic surfactants; (28) the so-called EO/PO Block polymers, including the diblock and triblock EPE and PEP types; (29) fatty acid polyglycol esters; (30) capped and non-capped alkyl or alkylphenol ethoxylates, propoxylates and butoxylates including fatty alcohol polyethyleneglycol ethers; (31) fatty alcohols, especially where useful as viscosity-modifying surfactants or present as unreacted components of other surfactants; (32) N-alkyl polyhydroxy fatty acid amides, especially the alkyl N-alkylglucamides; (33) nonionic surfactants derived from mono- or polysaccharides or sorbitan, especially the alkylpolyglycosides, as well as sucrose fatty acid esters; (34) ethylene glycol-, propylene glycol-, glycerol- and polyglyceryl-esters and their alkoxylates, especially glycerol ethers and the fatty acid/glycerol monoesters and diesters; (35) aldobionamide surfactants; (36) alkyl succinimide nonionic surfactant types; (37) acetylenic alcohol surfactants, such as the SURFYNOLS; (38) alkanolamide surfactants and their alkoxylated derivatives including fatty acid alkanolamides and fatty acid alkanolamide polyglycol ethers; (39) alkylpyrrolidones; (40) alkyl amine oxides, including alkoxylated or polyalkoxylated amine oxides and amine oxides derived from sugars; (41) alkyl phosphine oxides; (42) sulfoxide surfactants; (43) amphoteric sulfonates, especially sulfobetaines; (44) betaine-type amphoterics, including aminocarboxylate-derived types; (45) amphoteric sulfates such as the alkyl ammonio polyethoxysulfates; (46) fatty and petroleum-derived alkylamines and amine salts; (47) alkylimidazolines; (48) alkylamidoamines and their alkoxylate and polyalkoxylate derivatives; and (49) conventional cationic surfactants, including water-soluble alkyltrimethylammonium salts. Moreover, more unusual surfactant types are included, such as: (50) alkylamidoamine oxides, carboxylates and quaternary salts; (51) sugar-derived surfactants modeled after any of the hereinabove-referenced more conventional nonsugar types; (52) fluorosurfactants; (53) biosurfactants; (54) organosilicon surfactants; (55) gemini surfactants, other than the above-referenced diphenyl oxide disulfonates, including those derived from glucose; (56) polymeric surfactants including amphopolycarboxyglycinates; and (57) bolaform surfactants.

Regarding the conventional alkyl benzene sulfonates noted before, especially for substantially linear types including those made using AlCl3 or HF alkylation, suitable chainlengths are from about C10 to about C14. Such linear alkyl benzene sulfonate surfactants can be present in the instant compositions either as a result of being prepared separately and blended in, or as a result of being present in one or more precursors of the essential crystallinity-disrupted surfactants. Ratios of linear and present invention crystallinity-disrupted alkyl benzene sulfonate can vary from 100:1 to 1:100; more typically when using alkyl benzene sulfonates, at least about 0.1 weight fraction, preferably at least about 0.25 weight faction, is the crystallinity-disrupted surfactant of the present invention.

In any of the above detersive surfactants, hydrophobe chain length is typically in the general range C8–C20, with chain lengths in the range C8–C18 often being preferred, especially when laundering is to be conducted in cool water. Selection of chainlengths and degree of alkoxylation for conventional purposes are taught in the standard texts. When the detersive surfactant is a salt, any compatible cation may be present, including H (that is, the acid or partly acid form of a potentially acidic surfactant may be used), Na, K, Mg, ammonium or alkanolammonium, or combinations of cations. Mixtures of detersive surfactants having different charges are commonly preferred, especially anionic/cationic, anionic/nonionic, anionic/nonionic/cationic, anionic/nonionic/amphoteric, nonionic/cationic and nonionic/amphoteric mixtures. Moreover, any single detersive surfactant may be substituted, often with desirable results for cool water washing, by mixtures of otherwise similar detersive surfactants having differing chainlengths, degree of unsaturation or branching, degree of alkoxylation (especially ethoxylation), insertion of substituents such as ether oxygen atoms in the hydrophobes, or any combinations thereof.

Preferred among the above-identified detersive surfactants are: acid, sodium and ammonium C9–C20 linear alkylbenzenesulfonates, particularly sodium linear secondary alkyl C10–C15 benzenesulfonates (1); olefinsulfonate salts, (2), that is, material made by reacting olefins, particularly C10–C20 α-olefins, with sulfur trioxide and then neutralizing and hydrolyzing the reaction product; sodium and ammonium C7–C12 dialkyl sulfosuccinates, (3); alkane monosulfonates, (4), such as those derived by reacting C8–C20 α-olefins with sodium bisulfite and those derived by reacting paraffins with SO2 and C12 and then hydrolyzing with a base to form a random sulfonate; α-Sulfo fatty acid salts or esters, (10); sodium alkylglycerylsulfonates, (11), especially those ethers of the higher alcohols derived from tallow or coconut oil and synthetic alcohols derived from petroleum; alkyl or alkenyl sulfates, (15), which may be primary or secondary, saturated or unsaturated, branched or unbranched. Such compounds when branched can be random or regular. When secondary, they preferably have formula CH3(CH2)x(CHOSO3-M+) CH3 or CH3(CH2)y (CHOSO3-M+) CH2CH3 where x and (y+1) are integers of at least 7, preferably at least 9 and M is a water-soluble cation, preferably sodium. When unsaturated, sulfates such as oleyl sulfate are preferred, while the sodium and ammonium alkyl sulfates, especially those produced by sulfating C8–C18 alcohols, produced for example from tallow or coconut oil are also useful; also preferred are the alkyl or alkenyl ether sulfates, (16), especially the ethoxy sulphates having about 0.5 moles or higher of ethoxylation, preferably from 0.5–8; the alkylethercarboxylates, (19), especially the EO 1–5 ethoxycarboxylates; soaps or fatty acids (21), preferably the more water-soluble types; aminoacid-type surfactants, (23), such as sarcosinates, especially oleyl sarcosinate; phosphate esters, (26); alkyl or alkylphenol ethoxylates, propoxylates and butoxylates, (30), especially the ethoxylates "AE", including the so-called narrow peaked alkyl ethoxylates and C6–C12 alkyl phenol alkoxylates as well as the products of aliphatic primary or secondary linear or branched C8–C18 alcohols with ethylene oxide, generally 2–30 EO; N-alkyl polyhydroxy fatty acid amides especially the C12–C18 N-methylglucamides, (32), see WO 9206154, and N-alkoxy polyhydroxy fatty acid amides, such as C10–C18 N-(3-methoxypropyl) glucamide while N-propyl through N-hexyl C12–C18 glucamides can be used for low sudsing; alkyl polyglycosides, (33); amine oxides, (40), preferably alkyldimethylamine N-oxides and their dihydrates; sulfobetaines or "sultaines", (43); betaines (44); and gemini surfactants.

Suitable levels of anionic detersive surfactants herein are in the range from about 1% to about 50% or higher, preferably from about 2% to about 30%, more preferably still, from about 5% to about 20% by weight of the detergent composition.

Suitable levels of nonionic detersive surfactant herein are from about 1% to about 40%, preferably from about 2% to about 30%, more preferably from about 5% to about 20%.

Desirable weight ratios of anionic:nonionic surfactants in combination include from 1.0:9.0 to 1.0:0.25, preferably 1.0:1.5 to 1.0:0.4.

Suitable levels of cationic detersive surfactant herein are from about 0.1% to about 20%, preferably from about 1% to about 15%, although much higher levels, e.g., up to about 30% or more, may be useful especially in nonionic:cationic (i.e., limited or anionic-free) formulations.

Amphoteric or zwitterionic detersive surfactants when present are usually useful at levels in the range from about 0.1% to about 20% by weight of the detergent composition. Often levels will be limited to about 5% or less, especially when the amphoteric is costly.

Detersive Enzymes

Enzymes are preferably included in the present detergent compositions for a variety of purposes, including removal of protein-based, carbohydrate-based, or triglyceride-based stains from substrates, for the prevention of refugee dye transfer in fabric laundering, and for fabric restoration. Recent enzyme disclosures in detergents useful herein include bleach/amylase/protease combinations (EP 755,999 A; EP 756,001 A; EP 756,000 A); chondriotinase (EP 747,469 A); protease variants (WO 96/28566 A; WO 96/28557 A; WO 96/28556 A; WO 96/25489 A); xylanase (EP 709,452 A); keratinase (EP 747,470 A); lipase (GB 2,297,979 A; WO 96/16153 A; WO 96/12004 A; EP 698,659 A; WO 96/16154 A); cellulase (GB 2,294,269 A; WO 96/27649 A; GB 2,303,147 A); thermitase (WO 96/28558 A). More generally, suitable enzymes include proteases, amylases, lipases, cellulases, peroxidases, xylanases, keratinases, chondriotinases; thermitases, cutinases and mixtures thereof of any suitable origin, such as vegetable, animal, bacterial, fungal and yeast origin. Preferred selections are influenced by factors such as pH-activity and/or stability optima, thermostability, and stability to active detergents, builders and the like. In this respect bacterial or fungal enzymes are preferred, such as bacterial amylases and proteases, and fungal cellulases. Suitable enzymes are also described in U.S. Pat. Nos. 5,677,272, 5,679,630, 5,703,027, 5,703,034, 5,705,464, 5,707,950, 5,707,951, 5,710,115, 5,710,116, 5,710,118, 5,710,119 and 5,721,202.

"Detersive enzyme", as used herein, means any enzyme having a cleaning, stain removing or otherwise beneficial effect in a laundry, hard surface cleaning or personal care detergent composition. Preferred detersive enzymes are hydrolases such as proteases, amylases and lipases. Preferred enzymes for laundry purposes include, but are not limited to, proteases, cellulases, lipases and peroxidases. Highly preferred are amylases and/or proteases, including both current commercially available types and improved types which, though more and more bleach compatible though successive improvements, have a remaining degree of bleach deactivation susceptibility.

Enzymes are normally incorporated into detergent or detergent additive compositions at levels sufficient to provide a "cleaning-effective amount". The term "cleaning effective amount" refers to any amount capable of producing a cleaning, stain removal, soil removal, whitening, deodorizing, or freshness improving effect on substrates such as fabrics, dishware and the like. In practical terms for current commercial preparations, typical amounts are up to about 5 mg by weight, more typically 0.01 mg to 3 mg, of active enzyme per gram of the detergent composition. Stated otherwise, the compositions herein will typically comprise from 0.001% to 5%, preferably 0.01%–1% by weight of a commercial enzyme preparation. Protease enzymes are usually present in such commercial preparations at levels sufficient to provide from 0.005 to 0.1 Anson units (AU) of activity per gram of composition. For certain detergents it may be desirable to increase the active enzyme content of the commercial preparation in order to minimize the total amount of non-catalytically active materials and thereby improve spotting/filming or other end-results. Higher active levels may also be desirable in highly concentrated detergent formulations.

Suitable examples of proteases are the subtilisins which are obtained from particular strains of *B. subtilis* and *B. licheniformis*. One suitable protease is obtained from a strain of Bacillus, having maximum activity throughout the pH range of 8–12, developed and sold as ESPERASE® by Novo Industries A/S of Denmark, hereinafter "Novo". The preparation of this enzyme and analogous enzymes is described in GB 1,243,784 to Novo. Other suitable proteases include ALCALASE® and SAVINASE® from Novo and MAXATASE® from International Bio-Synthetics, Inc., The Netherlands; as well as Protease A as disclosed in EP 130,756 A, Jan. 9, 1985 and Protease B as disclosed in EP 303,761 A, Apr. 28, 1987 and EP 130,756 A, Jan. 9, 1985. See also a high pH protease from Bacillus sp. NCIMB 40338 described in WO 9318140 A to Novo. Enzymatic detergents comprising protease, one or more other enzymes, and a reversible protease inhibitor are described in WO 9203529 A to Novo. Other preferred proteases include those of WO 9510591 A to Procter & Gamble. When desired, a protease having decreased adsorption and increased hydrolysis is available as described in WO 9507791 to Procter & Gamble. A recombinant trypsin-like protease for detergents suitable herein is described in WO 9425583 to Novo.

In more detail, an especially preferred protease, referred to as "Protease D" is a carbonyl hydrolase variant having an amino acid sequence not found in nature, which is derived from a precursor carbonyl hydrolase by substituting a different amino acid for a plurality of amino acid residues at a position in said carbonyl hydrolase equivalent to position +76, preferably also in combination with one or more amino acid residue positions equivalent to those selected from the group consisting of +99, +101, +103, +104, +107, +123, +27, +105, +109, +126, +128, +135, +156, +166, +195, +197, +204, +206, +210, +216, +217, +218, +222, +260, +265, and/or +274 according to the numbering of *Bacillus amyloliquefaciens* subtilisin, as described in WO 95/10615 published Apr. 20, 1995 by Genencor International.

Useful proteases are also described in PCT publications: WO 95/30010 published Nov. 9, 1995 by The Procter & Gamble Company; WO 95/30011 published Nov. 9, 1995 by The Procter & Gamble Company; WO 95/29979 published Nov. 9, 1995 by The Procter & Gamble Company.

Amylases suitable herein include, for example, α-amylases described in GB 1,296,839 to Novo; RAPIDASE®, International Bio-Synthetics, Inc. and TERMAMYL®, Novo. FUNGAMYL® from Novo is especially useful. Engineering of enzymes for improved stability, e.g., oxidative stability, is known. See, for example J. Biological Chem., Vol. 260, No. 11, June 1985, pp. 6518–6521. Certain preferred embodiments of the present compositions can make use of amylases having improved stability in detergents, especially improved oxidative stability as measured against a reference-point of TERMAMYL® in commercial use in 1993. These preferred amylases herein share the characteristic of being "stability-enhanced" amylases, characterized, at a minimum, by a measurable improvement in one or more of: oxidative stability, e.g., to hydrogen peroxide/tetraacetylethylenediamine in buffered solution at pH 9–10; thermal stability, e.g., at common wash temperatures such as about 60° C.; or alkaline stability, e.g., at a pH from about 8 to about 11, measured versus the above-identified reference-point amylase. Stability can be measured using any of the art-disclosed technical tests. See, for example, references disclosed in WO 9402597. Stability-enhanced amylases can be obtained from Novo or from Genencor International. One class of highly preferred amylases herein have the commonality of being derived using site-directed mutagenesis from one or more of the Bacillus amylases, especially the Bacillus α-amylases, regardless of whether one, two or multiple amylase strains are the immediate precursors. Oxidative stability-enhanced amylases vs. the above-identified reference amylase are preferred for use, especially in bleaching, more preferably oxygen bleaching, as distinct from chlorine bleaching, detergent compositions herein. Such preferred amylases include (a) an amylase according to the hereinbefore incorporated WO 9402597, Novo, Feb. 3, 1994, as further illustrated by a mutant in which substitution is made, using alanine or threonine, preferably threonine, of the methionine residue located in position 197 of the *B. licheniformis* alpha-amylase, known as TERMAMYL®, or the homologous position variation of a similar parent amylase, such as *B. amyloliquefaciens, B. subtilis*, or *B. stearothermophilus*; (b) stability-enhanced amylases as described by Genencor International in a paper entitled "Oxidatively Resistant alpha-Amylases" presented at the 207th American Chemical Society National Meeting, Mar. 13–17, 1994, by C. Mitchinson. Therein it was noted that bleaches in automatic dishwashing detergents inactivate alpha-amylases but that improved oxidative stability amylases have been made by Genencor from *B. licheniformis* NCIB8061. Methionine (Met) was identified as the most likely residue to be modified. Met was substituted, one at a time, in positions 8, 15, 197, 256, 304, 366 and 438 leading to specific mutants, particularly important being M197L and M197T with the M197T variant being the most stable expressed variant. Stability was measured in CASCADE® and SUNLIGHT®; (c) particularly preferred amylases herein include amylase variants having additional modification in the immediate parent as described in WO 9510603 A and are available from the assignee, Novo, as DURAMYL®. Other particularly preferred oxidative stability enhanced amylase include those described in WO 9418314 to Genencor International and WO 9402597 to Novo. Any other oxidative stability-enhanced amylase can be used, for example as derived by site-directed mutagenesis from known chimeric, hybrid or simple mutant parent forms of available amylases. Other preferred enzyme modifications are accessible. See WO 9509909 A to Novo.

Other amylase enzymes include those described in WO 95/26397 and in co-pending application by Novo Nordisk PCT/DK96/00056. Specific amylase enzymes for use in the detergent compositions of the present invention include α-amylases characterized by having a specific activity at least 25% higher than the specific activity of Termamyl® at a temperature range of 25° C. to 55° C. and at a pH value in the range of 8 to 10, measured by the Phadebas® α-amylase activity assay. (Such Phadebas® α-amylase activity assay is described at pages 9–10, WO 95/26397.)

Also included herein are α-amylases which are at least 80% homologous with the amino acid sequences shown in the SEQ ID listings in the references. These enzymes are preferably incorporated into laundry detergent compositions at a level from 0.00018% to 0.060% pure enzyme by weight of the total composition, more preferably from 0.00024% to 0.048% pure enzyme by weight of the total composition.

Cellulases usable herein include both bacterial and fungal types, preferably having a pH optimum between 5 and 9.5. U.S. Pat. No. 4,435,307, Barbesgoard et al, Mar. 6, 1984, discloses suitable fungal cellulases from Humicola insolens or Humicola strain DSM1800 or a cellulase 212-producing fungus belonging to the genus Acromonas, and cellulase extracted from the hepatopancreas of a marine mollusk, *Dolabella Auricula Solander*. Suitable cellulases are also disclosed in GB-A-2.075.028; GB-A-2.095.275 and DE-OS-2.247.832. CAREZYME® and CELLUZYME® (Novo) are especially useful. See also WO 9117243 to Novo.

Suitable lipase enzymes for detergent usage include those produced by microorganisms of the Pseudomonas group, such as *Pseudomonas stutzeri* ATCC 19.154, as disclosed in GB 1,372,034. See also lipases in Japanese Patent Application 53,20487, laid open Feb. 24, 1978. This lipase is available from Amano Pharmaceutical Co. Ltd., Nagoya, Japan, under the trade name Lipase P "Amano," or "Amano-P." Other suitable commercial lipases include Amano-CES, lipases ex *Chromobacter viscosum*, e.g. *Chromobacter viscosum* var. *lipolyticum* NRRLB 3673 from Toyo Jozo Co., Tagata, Japan; *Chromobacter viscosum* lipases from U.S. Biochemical Corp., U.S.A. and Disoynth Co., The Netherlands, and lipases ex *Pseudomonas gladioli*. LIPOLASE® enzyme derived from *Humicola lanuginosa* and commercially available from Novo, see also EP 341,947, is a preferred lipase for use herein. Lipase and amylase variants stabilized against peroxidase enzymes are described in WO 9414951 A to Novo. See also WO 9205249 and RD 94359044.

Cutinase enzymes suitable for use herein are described in WO 8809367 A to Genencor.

Peroxidase enzymes may be used in combination with oxygen sources, e.g., percarbonate, perborate, hydrogen peroxide, etc., for "solution bleaching" or prevention of transfer of dyes or pigments removed from substrates during the wash to other substrates present in the wash solution. Known peroxidases include horseradish peroxidase, ligninase, and haloperoxidases such as chloro- or bromo-peroxidase. Peroxidase-containing detergent compositions are disclosed in WO 89099813 A, Oct. 19, 1989 to Novo and WO 8909813 A to Novo.

A range of enzyme materials and means for their incorporation into synthetic detergent compositions is also disclosed in WO 9307263 A and WO 9307260 A to Genencor International, WO 8908694 A to Novo, and U.S. Pat. No. 3,553,139, Jan. 5, 1971 to McCarty et al. Enzymes are further disclosed in U.S. Pat. No. 4,101,457, Place et al, Jul. 18, 1978, and in U.S. Pat. No. 4,507,219, Hughes, Mar. 26, 1985. Enzyme materials useful for liquid detergent formulations, and their incorporation into such formulations, are disclosed in U.S. Pat. No. 4,261,868, Hora et al, Apr. 14, 1981. Enzymes for use in detergents can be stabilized by various techniques. Enzyme stabilization techniques are disclosed and exemplified in U.S. Pat. No. 3,600,319, Aug. 17, 1971, Gedge et al, EP 199,405 and EP 200,586, Oct. 29, 1986, Venegas. Enzyme stabilization systems are also described, for example, in U.S. Pat. No. 3,519,570. A useful Bacillus, sp. AC13 giving proteases, xylanases and cellulases, is described in WO 9401532 A to Novo.

Builders

Detergent builders are preferably included in the compositions herein, for example to assist in controlling mineral, especially Ca and/or Mg, hardness in wash water or to assist in the removal and/or suspension of particulate soils from surfaces and sometimes to provide alkalinity and/or buffering action. In solid formulations, builders sometimes serve as absorbents for surfactants. Alternately, certain compositions can be formulated with completely water-soluble builders, whether organic or inorganic, depending on the intended use.

Suitable silicate builders include water-soluble and hydrous solid types and including those having chain-, layer-, or three-dimensional-structure as well as amorphous-solid silicates or other types, for example especially adapted for use in non-structured-liquid detergents. Preferred are alkali metal silicates, particularly those liquids and solids having a $SiO_2$: $Na_2O$ ratio in the range 1.6:1 to 3.2:1, including solid hydrous 2-ratio silicates marketed by PQ Corp. under the tradename BRITESIL®, e.g., BRITESIL H2O; and layered silicates, e.g., those described in U.S. Pat. No. 4,664,839, May 12, 1987, H. P. Rieck. NaSKS-6, sometimes abbreviated "SKS-6", is a crystalline layered aluminum-free δ-$Na_2SiO_5$ morphology silicate marketed by Hoechst and is preferred especially in granular laundry compositions. See preparative methods in German DE-A-3,417,649 and DE-A-3,742,043. Other layered silicates, such as those having the general formula $NaMSi_xO_{2x+1}.yH_2O$ wherein M is sodium or hydrogen, x is a number from 1.9 to 4, preferably 2, and y is a number from 0 to 20, preferably 0, can also or alternately be used herein. Layered silicates from Hoechst also include NaSKS-5, NaSKS-7 and NaSKS-11, as the α, β and γ layer-silicate forms. Other silicates may also be useful, such as magnesium silicate, which can serve as a crispening agent in granules, as a stabilizing agent for bleaches, and as a component of suds control systems.

Also suitable for use herein are synthesized crystalline ion exchange materials or hydrates thereof having chain structure and a composition represented by the following general formula in an anhydride form: $xM_2O.ySiO_2.zM'O$ wherein M is Na and/or K, M' is Ca and/or Mg; y/x is 0.5 to 2.0 and z/x is 0.005 to 1.0 as taught in U.S. Pat. No. 5,427,711, Sakaguchi et al, Jun. 27, 1995.

Aluminosilicate builders, such as zeolites, are especially useful in granular detergents, but can also be incorporated in liquids, pastes or gels. Suitable for the present purposes are those having empirical formula: $[M_z(AlO_2)_z(SiO_2)_v].xH_2O$ wherein z and v are integers of at least 6, the molar ratio of z to v is in the range from 1.0 to 0.5, and x is an integer from 15 to 264. Aluminosilicates can be crystalline or amorphous, naturally-occurring or synthetically derived. An aluminosilicate production method is in U.S. Pat. No. 3,985,669, Krummel, et al, Oct. 12, 1976. Preferred synthetic crystalline aluminosilicate ion exchange materials are available as Zeolite A, Zeolite P (B), Zeolite X and, to whatever extent this differs from Zeolite P, the so-called Zeolite MAP. Natural types, including clinoptilolite, may be used. Zeolite A has the formula: $Na_{12}[(AlO_2)_{12}(SiO_2)_{12}].xH_2O$ wherein x is from 20 to 30, especially 27. Dehydrated zeolites (x=0–10) may also be used. Preferably, the aluminosilicate has a particle size of 0.1–10 microns in diameter.

Detergent builders in place of or in addition to the silicates and aluminosilicates described hereinbefore can optionally be included in the compositions herein, for example to assist in controlling mineral, especially Ca and/or Mg, hardness in wash water or to assist in the removal of particulate soils from surfaces. Builders can operate via a variety of mechanisms including forming soluble or insoluble complexes with hardness ions, by ion exchange, and by offering a surface more favorable to the precipitation of hardness ions than are the surfaces of articles to be cleaned. Builder level can vary widely depending upon end use and physical form of the composition. Built detergents typically comprise at least about 1% builder. Liquid formulations typically comprise about 5% to about 50%, more typically 5% to 35% of builder. Granular formulations typically comprise from about 10% to about 80%, more typically 15% to 50% builder by weight of the detergent composition. Lower or higher levels of builders are not excluded. For example, certain detergent additive or hiah-surfactant formulations can be unbuilt.

Suitable builders herein can be selected from the group consisting of phosphates and polyphosphates, especially the sodium salts; carbonates, bicarbonates, sesquicarbonates and carbonate minerals other than sodium carbonate or sesquicarbonate; organic mono-, di-, tri-, and tetracarboxylates especially water-soluble nonsurfactant carboxylates in acid, sodium, potassium or alkanolammonium salt form, as well as oligomeric or water-soluble low molecular weight polymer carboxylates including aliphatic and aromatic types; and phytic acid. These may be complemented by borates, e.g., for pH-buffering purposes, or by sulfates, especially sodium sulfate and any other fillers or carriers which may be important to the engineering of stable surfactant and/or builder-containing detergent compositions.

Builder mixtures, sometimes termed "builder systems" can be used and typically comprise two or more conventional builders, optionally complemented by chelants, pH-buffers or fillers, though these latter materials are generally accounted for separately when describing quantities of materials herein. In terms of relative quantities of surfactant and builder in the present detergents, preferred builder systems are typically formulated at a weight ratio of surfactant to builder of from about 60:1 to about 1:80. Certain preferred laundry detergents have said ratio in the range 0.90:1.0 to 4.0:1.0, more preferably from 0.95:1.0 to 3.0:1.0.

P-containing detergent builders often preferred where permitted by legislation include, but are not limited to, the alkali metal, ammonium and alkanolammonium salts of polyphosphates exemplified by the tripolyphosphates, pyrophosphates, glassy polymeric meta-phosphates; and phosphonates.

Suitable carbonate builders include alkaline earth and alkali metal carbonates as disclosed in German Patent Application No. 2,321,001 published on Nov. 15, 1973, although sodium bicarbonate, sodium carbonate, sodium sesquicarbonate, and other carbonate minerals such as trona or any convenient multiple salts of sodium carbonate and calcium carbonate such as those having the composition 2Na2CO3.CaCO3 when anhydrous, and even calcium carbonates including calcite, aragonite and vaterite, especially forms having high surface areas relative to compact calcite may be useful, for example as seeds or for use in synthetic detergent bars.

Suitable "organic detergent builders", as described herein for use with the alkylarylsulfonate surfactant system include polycarboxylate compounds, including water-soluble nonsurfactant dicarboxylates and tricarboxylates. More typically builder polycarboxylates have a plurality of carboxylate groups, preferably at least 3 carboxylates. Carboxylate builders can be formulated in acid, partially neutral, neutral or overbased form. When in salt form, alkali metals, such as sodium, potassium, and lithium, or alkanolammonium salts are preferred. Polycarboxylate builders include the ether polycarboxylates, such as oxydisuccinate, see Berg, U.S. Pat. No. 3,128,287, Apr. 7, 1964, and Lamberti et al, U.S. Pat. No. 3,635,830, Jan. 18, 1972; "TMS/TDS" builders of U.S. Pat. No. 4,663,071, Bush et al, May 5, 1987; and other ether carboxylates including cyclic and alicyclic compounds, such as those described in U.S. Pat. Nos. 3,923,679; 3,835,163; 4,158,635; 4,120,874 and 4,102,903.

Other suitable organic detergent builders are the ether hydroxy-polycarboxylates, copolymers of maleic anhydride with ethylene or vinyl methyl ether; 1,3,5-trihydroxy benzene-2,4,6-trisulphonic acid; carboxymethyloxysuccinic acid; the various alkali metal, ammonium and substituted ammonium salts of polyacetic acids such as ethylenediamine tetraacetic acid and nitrilotriacetic acid; as well as mellitic acid, succinic acid, polymaleic acid, benzene 1,3,5-tricarboxylic acid, carboxymethyloxysuccinic acid, and soluble salts thereof.

Citrates, e.g., citric acid and soluble salts thereof are important carboxylate builders e.g., for heavy duty liquid detergents, due to availability from renewable resources and biodegradability. Citrates can also be used in granular compositions, especially in combination with zeolite and/or layered silicates. Oxydisuccinates are also especially useful in such compositions and combinations.

Where permitted, and especially in the formulation of bars used for hand-laundering operations, alkali metal phosphates such as sodium tripolyphosphates, sodium pyrophosphate and sodium orthophosphate can be used. Phosphonate builders such as ethane-1-hydroxy-1,1-diphosphonate and other known phosphonates, e.g., those of U.S. Pat. Nos. 3,159,581; 3,213,030; 3,422,021; 3,400,148 and 3,422,137 can also be used and may have desirable antiscaling properties.

Certain detersive surfactants or their short-chain homologues also have a builder action. For unambiguous formula accounting purposes, when they have surfactant capability, these materials are summed up as detersive surfactants. Preferred types for builder functionality are illustrated by: 3,3-dicarboxy-4-oxa-1,6-hexanedioates and the related compounds disclosed in U.S. Pat. No. 4,566,984, Bush, Jan. 28, 1986. Succinic acid builders include the C5–C20 alkyl and alkenyl succinic acids and salts thereof. Succinate builders also include: laurylsuccinate, myristylsuccinate, palmitylsuccinate, 2-dodecenylsuccinate (preferred), 2-pentadecenylsuccinate, and the like. Lauryl-succinates are described in European Patent Application 86200690.5/0, 200,263, published Nov. 5, 1986. Fatty acids, e.g., C12–C18 monocarboxylic acids, can also be incorporated into the compositions as surfactant/builder materials alone or in combination with the aforementioned builders, especially citrate and/or the succinate builders, to provide additional builder activity. Other suitable polycarboxylates are disclosed in U.S. Pat. No. 4,144,226, Crutchfield et al, Mar. 13, 1979 and in U.S. Pat. No. 3,308,067, Diehl, Mar. 7, 1967. See also Diehl, U.S. Pat. No. 3,723,322.

Other types of inorganic builder materials which can be used have the formula (Mx)i Cay (CO3)z wherein x and i are integers from 1 to 15, y is an integer from 1 to 10, z is an integer from 2 to 25, Mi are cations, at least one of which is a water-soluble, and the equation $\Sigma i=1–15$(xi multiplied by the valence of Mi)+2y=2z is satisfied such that the formula has a neutral or "balanced" charge. These builders are referred to herein as "Mineral Builders", examples of these builders, their use and preparation can be found in U.S. Pat. No. 5,707,959. Another suitable class of inorganic builders are the Magnesiosilicates, see WO97/0179.

Oxygen Bleaching Agents:

Preferred compositions of the present invention comprise, as part or all of the laundry or cleaning adjunct materials, an "oxygen bleaching agent". Oxygen bleaching agents useful in the present invention can be any of the oxidizing agents known for laundry, hard surface cleaning, automatic dishwashing or denture cleaning purposes. Oxygen bleaches or mixtures thereof are preferred, though other oxidant bleaches, such as oxygen, an enzymatic hydrogen peroxide producing system, or hypohalites such as chlorine bleaches like hypochlorite, may also be used.

Common oxygen bleaches of the peroxygen type include hydrogen peroxide, inorganic peroxohydrates, organic peroxohydrates and the organic peroxyacids, including hydrophilic and hydrophobic mono- or di-peroxyacids. These can be peroxycarboxylic acids, peroxyimidic acids, amidoperoxycarboxylic acids, or their salts including the calcium, magnesium, or mixed-cation salts. Peracids of various kinds can be used both in free form and as precursors known as "bleach activators" or "bleach promoters" which, when combined with a source of hydrogen peroxide, perhydrolyze to release the corresponding peracid.

Also useful herein as oxygen bleaches are the inorganic peroxides such as Na2O2, superoxides such as KO2, organic hydroperoxides such as cumene hydroperoxide and t-butyl hydroperoxide, and the inorganic peroxoacids and their salts such as the peroxosulfuric acid salts, especially the potassium salts of peroxodisulfuric acid and, more preferably, of peroxomonosulfuric acid including the commercial triple-salt form sold as OXONE by DuPont and also any equivalent commercially available forms such as CUROX from Akzo or CAROAT from Degussa. Certain organic peroxides, such as dibenzoyl peroxide, may be useful, especially as additives rather than as primary oxygen bleach.

Mixed oxygen bleach systems are generally useful, as are mixtures of any oxygen bleaches with the known bleach activators, organic catalysts, enzymatic catalysts and mixtures thereof, moreover such mixtures may further include brighteners, photobleaches and dye transfer inhibitors of types well-known in the art.

Preferred oxygen bleaches, as noted, include the peroxohydrates, sometimes known as peroxyhydrates or peroxohydrates. These are organic or, more commonly, inorganic salts capable of releasing hydrogen peroxide readily. Peroxohydrates are the most common examples of "hydrogen peroxide source" materials and include the perborates, percarbonates, perphosphates, and persilicates. Suitable peroxohydrates include sodium carbonate peroxyhydrate and equivalent commercial "percarbonate" bleaches, and any of the so-called sodium perborate hydrates, the "tetrahydrate" and "monohydrate" being preferred; though sodium pyrophosphate peroxyhydrate can be used. Many such peroxohydrates are available in processed forms with coatings, such as of silicate and/or borate and/or waxy materials and/or surfactants, or have particle geometries, such as compact spheres, which improve storage stability. By way of organic peroxohydrates, urea peroxyhydrate can also be useful herein.

Percarbonate bleach includes, for example, dry particles having an average particle size in the range from about 500 micrometers to about 1,000 micrometers, not more than about 10% by weight of said particles being smaller than about 200 micrometers and not more than about 10% by weight of said particles being larger than about 1,250 micrometers. Percarbonates and perborates are widely available in commerce, for example from FMC, Solvay and Tokai Denka.

Organic percarboxylic acids useful herein as the oxygen bleach include magnesium monoperoxyphthalate hexahydrate, available from Interox, m-chloro perbenzoic acid and its salts, 4-nonylamino-4-oxoperoxybutyric acid and diperoxydodecanedioic acid and their salts. Such bleaches are disclosed in U.S. Pat. No. 4,483,781, U.S. Pat. application Ser. No. 740,446, Burns et al, filed Jun. 3, 1985, EP-A 133,354, published Feb. 20, 1985, and U.S. Pat. No. 4,412,934. Organic percarboxylic acids usable herein include those containing one, two or more peroxy groups, and can be aliphatic or aromatic. Highly preferred oxygen bleaches also include 6-nonylamino-6-oxoperoxycaproic acid (NAPAA) as described in U.S. Pat. No. 4,634,551.

An extensive and exhaustive listing of useful oxygen bleaches, including inorganic peroxohydrates, organic peroxohydrates and the organic peroxyacids, including hydrophilic and hydrophobic mono- or di-peroxyacids, peroxycarboxylic acids, peroxyimidic acids, amidoperoxycarboxylic acids, or their salts including the calcium, magnesium, or mixed-cation salts, can be found in U.S. Pat. Nos. 5,622,646 and 5,686,014.

Other useful peracids and bleach activators herein are in the family of imidoperacids and imido bleach activators. These include phthaloylimidoperoxycaproic acid and related arylimido-substituted and acyloxynitrogen derivatives. For listings of such compounds, preparations and their incorporation into laundry compositions including both granules and liquids, See U.S. Pat. No. 5,487,818; U.S. Pat. No. 5,470,988, U.S. Pat. No. 5,466,825; U.S. Pat. No. 5,419,846; U.S. Pat. No. 5,415,796; U.S. Pat. No. 5,391,324; U.S. Pat. No. 5,328,634; U.S. Pat. No. 5,310,934; U.S. Pat. No. 5,279,757; U.S. Pat. No. 5,246,620; U.S. Pat. No. 5,245,075; U.S. Pat. No. 5,294,362; U.S. Pat. No. 5,423,998; U.S. Pat. No. 5,208,340; U.S. Pat. No. 5,132,431 and U.S. Pat. No. 5,087385.

Useful diperoxyacids include, for example, 1,12-diperoxydodecanedioic acid (DPDA); 1,9-diperoxyazelaic acid; diperoxybrassilic acid; diperoxysebasic acid and diperoxyisophthalic acid; 2-decyldiperoxybutane-1,4-dioic acid; and 4,4'-sulphonylbisperoxybenzoic acid.

More generally, the terms "hydrophilic" and "hydrophobic" used herein in connection with any of the oxygen bleaches, especially the peracids, and in connection with bleach activators, are in the first instance based on whether a given oxygen bleach effectively performs bleaching of fugitive dyes in solution thereby preventing fabric graying and discoloration and/or removes more hydrophilic stains such as tea, wine and grape juice—in this case it is termed "hydrophilic". When the oxygen bleach or bleach activator has a significant stain removal, whiteness-improving or cleaning effect on dingy, greasy, carotenoid, or other hydrophobic soils, it is termed "hydrophobic". The terms are applicable also when referring to peracids or bleach activators used in combination with a hydrogen peroxide source. The current commercial benchmarks for hydrophilic performance of oxygen bleach systems are: TAED or peracetic acid, for benchmarking hydrophilic bleaching. NOBS or NAPAA are the corresponding benchmarks for hydrophobic bleaching. The terms "hydrophilic", "hydrophobic" and "hydrotropic" with reference to oxygen bleaches including peracids and here extended to bleach activator have also been used somewhat more narrowly in the literature. See especially Kirk Othmer's Encyclopedia of Chemical Technology, Vol. 4., pages 284–285. This reference provides a chromatographic retention time and critical micelle concentration-based set of criteria, and is useful to identify and/or characterize preferred sub-classes of hydrophobic, hydrophilic and hydrotropic oxygen bleaches and bleach activators that can be used in the present invention.

Bleach Activators

Bleach activators useful herein include amides, imides, esters and anhydrides. Commonly at least one substituted or unsubstituted acyl moiety is present, covalently connected to a leaving group as in the structure R—C(O)—L. In one preferred mode of use, bleach activators are combined with a source of hydrogen peroxide, such as the perborates or percarbonates, in a single product. Conveniently, the single product leads to in situ production in aqueous solution (i.e., during the washing process) of the percarboxylic acid corresponding to the bleach activator. The product itself can be hydrous, for example a powder, provided that water is controlled in amount and mobility such that storage stability is acceptable. Alternately, the product can be an anhydrous solid or liquid. In another mode, the bleach activator or oxygen bleach is incorporated in a pretreatment product, such as a stain stick; soiled, pretreated substrates can then be exposed to further treatments, for example of a hydrogen peroxide source. With respect to the above bleach activator structure RC(O)L, the atom in the leaving group connecting to the peracid-forming acyl moiety R(C)O— is most typically O or N. Bleach activators can have non-charged, positively or negatively charged peracid-forming moieties and/or noncharged, positively or negatively charged leaving groups. One or more peracid-forming moieties or leaving-groups can be present. See, for example, U.S. Pat. No. 5,595,967, U.S. Pat. No. 5,561,235, U.S. Pat. No. 5,560,862 or the bis-(peroxy-carbonic) system of U.S. Pat. No. 5,534,179. Mixtures of suitable bleach activators can also be used. Bleach activators can be substituted with electron-donating or electron-releasing moieties either in the leaving-group or in the peracid-forming moiety or moieties, changing their reactivity and making them more or less suited to particular ply or wash conditions. For example, electron-withdrawing groups such as NO2 improve the efficacy of bleach activators intended for use in mild-pH (e.g., from about 7.5–to about 9.5) wash conditions.

An extensive and exhaustive disclosure of suitable bleach activators and suitable leaving groups, as well as how to determine suitable activators, can be found in U.S. Pat. Nos. 5,686,014 and 5,622,646.

Cationic bleach activators include quaternary carbamate-, quaternary carbonate-, quaternary ester- and quaternary amide-types, delivering a range of cationic peroxyimidic, peroxycarbonic or peroxycarboxylic acids to the wash. An analogous but non-cationic palette of bleach activators is available when quaternary derivatives are not desired. In more detail, cationic activators include quaternary ammonium-substituted activators of WO 96-06915, U.S. Pat. No. 4,751,015 and 4,397,757, EP-A-284292, EP-A-331,229 and EP-A-03520. Also useful are cationic nitrites as disclosed in EP-A-303,520 and in European Patent Specification 458,396 and 464,880. Other nitrile types have electron-withdrawing substituents as described in U.S. Pat. No. 5,591,378.

Other bleach activator disclosures include GB 836,988; 864,798; 907,356; 1,003,310 and 1,519,351; German Patent 3,337,921; EP-A-0185522; EP-A-0174132; EP-A-0120591; U.S. Pat. Nos. 1,246,339; 3,332,882; 4,128,494; 4,412,934 and 4,675,393, and the phenol sulfonate ester of alkanoyl aminoacids disclosed in U.S. Pat. No. 5,523,434. Suitable bleach activators include any acetylated diamine types, whether hydrophilic or hydrophobic in character.

Of the above classes of bleach precursors, preferred classes include the esters, including acyl phenol sulfonates, acyl alkyl phenol sulfonates or acyl oxybenzenesulfonates (OBS leaving-group); the acyl-amides; and the quaternary ammonium substituted peroxyacid precursors including the cationic nitrites.

Preferred bleach activators include N,N,N'N'-tetraacetyl ethylene diamine (TAED) or any of its close relatives including the triacetyl or other unsymmetrical derivatives. TAED and the acetylated carbohydrates such as glucose pentaacetate and tetraacetyl xylose are preferred hydrophilic bleach activators. Depending on the application, acetyl triethyl citrate, a liquid, also has some utility, as does phenyl benzoate.

Preferred hydrophobic bleach activators include sodium nonanoyloxybenzene sulfonate (NOBS or SNOBS), N-(alkanoyl)aminoalkanoyloxy benzene sulfonates, such as 4-[N-(nonanoyl)aminohexanoyloxy]-benzene sulfonate or (NACA-OBS) as described in U.S. Pat. No. 5,534,642 and in EPA 0 355 384 A1, substituted amide types described in detail hereinafter, such as activators related to NAPAA, and activators related to certain imidoperacid bleaches, for example as described in U.S. Pat. No. 5,061,807, issued Oct. 29, 1991 and assigned to Hoechst Aktiengesellschaft of Frankfurt, Germany and Japanese Laid-Open Patent Application (Kokai) No. 4-28799.

Another group of peracids and bleach activators herein are those derivable from acyclic imidoperoxycarboxylic acids and salts thereof, See U.S. Pat. No. 5415796, and cyclic imidoperoxycarboxylic acids and salts thereof, see U.S. Pat. Nos. 5,061,807, 5,132,431, 5,6542,69, 5,246,620, 5,419,864 and 5,438,147.

Other suitable bleach activators include sodium-4-benzoyloxy benzene sulfonate (SBOBS); sodium-1-methyl-2-benzoyloxy benzene-4-sulphonate; sodium-4-methyl-3-benzoyloxy benzoate (SPCC); trimethyl ammonium toluyloxy-benzene sulfonate; or sodium 3,5,5-trimethyl hexanoyloxybenzene sulfonate (STHOBS).

Bleach activators may be used in an amount of up to 20%, preferably from 0.1–10% by weight, of the composition, though higher levels, 40% or more, are acceptable, for example in highly concentrated bleach additive product forms or forms intended for appliance automated dosing.

Highly preferred bleach activators useful herein are amide-substituted and an extensive and exhaustive disclosure of these activators can be found in U.S. Pat. Nos. 5,686,014 and 5,622,646.

Other useful activators, disclosed in U.S. Pat. No. 4,966,723, are benzoxazin-type, such as a $C_6H_4$ ring to which is fused in the 1,2-positions a moiety—C(O)OC($R^1$)═N—. A highly preferred activator of the benzoxazin-type is:

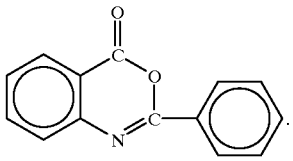

Depending on the activator and precise application, good bleaching results can be obtained from bleaching systems having with in-use pH of from about 6 to about 13, preferably from about 9.0 to about 10.5. Typically, for example, activators with electron-withdrawing moieties are used for near-neutral or sub-neutral pH ranges. Alkalis and buffering agents can be used to secure such pH.

Acyl lactam activators are very useful herein, especially the acyl caprolactams (see for example WO 9428102 A) and acyl valerolactams (see U.S. Pat. No. 5,503,639). See also U.S. Pat. No. 4,545,784 which discloses acyl caprolactams, including benzoyl caprolactam adsorbed into sodium perborate. In certain preferred embodiments of the invention, NOBS, lactam activators, imide activators or amide-functional activators, especially the more hydrophobic derivatives, are desirably combined with hydrophilic activators such as TAED, typically at weight ratios of hydrophobic activator: TAED in the range of 1:5 to 5:1, preferably about 1:1. Other suitable lactam activators are alpha-modified, see WO 96-22350 A1, Jul. 25, 1996. Lactam activators, especially the more hydrophobic types, are desirably used in combination with TAED, typically at weight ratios of amido-derived or caprolactam activators:TAED in the range of 1:5 to 5:1, preferably about 1:1. See also the bleach activators having cyclic amidine leaving-group disclosed in U.S. Pat. No. 5,552,556.

Nonlimiting examples of additional activators useful herein are to be found in U.S. Pat. No. 4,915,854, U.S. Pat. Nos. 4,412,934 and 4,634,551. The hydrophobic activator nonanoyloxybenzene sulfonate (NOBS) and the hydrophilic tetraacetyl ethylene diamine (TAED) activator are typical, and mixtures thereof can also be used.

Additional activators useful herein include those of U.S. Pat. No. 5,545,349.

Transition Metal Bleach Catalysts:

If desired, the bleaching compounds can be catalyzed by means of a manganese compound. Such compounds are well known in the art and include, for example, the manganese-based catalysts disclosed in U.S. Pat. No. 5,246,621, U.S. Pat. No. 5,244,594; U.S. Pat. No. 5,194,416; U.S. Pat. No. 5,114,606; European Pat. App. Pub. Nos. 549,271A1, 549,272A1, 544,440A2, 544,490A1; and PCT applications PCT/IB98/00298, PCT/IB98/00299, PCT/IB98/00300, and PCT/IB98/00302; Preferred examples of these catalysts include MnIV2(u-O)3(1,4,7-trimethyl-1,4,7-triazacyclononane)2(PF6)2, MnIII2(u-O)1(u-OAc)2(1,4,7-trimethyl-1,4,7-triazacyclononane)2(ClO4)2, MnIV4(u-O)6(1,4,7-triazacyclononane)4(ClO4)4, MnIIIMnIV4(u-O)1(u-OAc)2(1,4,7-trimethyl-1,4,7-triazacyclononane)2(ClO4)3, MnIV(1,4,7-trimethyl-1,4,7-tri-azacyclononane)-(OCH3)3(PF6), and mixtures thereof. Other metal-based bleach catalysts include those disclosed in U.S. Pat. Nos. 4,430,243, 5,114,611, 5,622,646 and 5,686,014. The use of manganese with various complex ligands to enhance bleaching is also reported in the following U.S. Pat. Nos.: 4,728,455; 5,284,944; 5,246,612; 5,256,779; 5,280,117; 5,274,147; 5,153,161; and 5,227,084.

Cobalt bleach catalysts useful herein are known, and are described, for example, in M. L. Tobe, "Base Hydrolysis of Transition-Metal Complexes", *Adv. Inorg. Bioinorg. Mech.*, (1983), 2, pages 1–94. The most preferred cobalt catalyst useful herein are cobalt pentaamine acetate salts having the formula [Co(NH3)5OAc]Ty, wherein "OAc" represents an acetate moiety and "Ty" is an anion, and especially cobalt pentaamine acetate chloride, [Co(NH3)5OAc]C12; as well as [Co(NH3)5OAc](OAc)2; [Co(NH3)5OAc](PF6)2; [Co(NH3)5OAc](SO4); [Co(NH3)5OAc](BF4)2; and [Co(NH3)5OAc](NO3)2 (herein "PAC"). These cobalt catalysts are readily prepared by known procedures, such as taught for example in the Tobe article and the references cited therein, and in U.S. Pat. No. 4,810,410, to Diakun et al, issued Mar. 7, 1989.

Compositions herein may also suitably include as a bleach catalyst the class of transition metal complexes of a macropolycyclic rigid ligand. The phrase "macropolycyclic rigid ligand" is sometimes abbreviated as "MRL". One useful MRL is [MnByclamC12], where "Bcyclam" is (5,12-dimethyl-1,5,8,12-tetraazabicyclo[6.6.2]hexadecane). See PCT applications PCT/IB98/00298, PCT/IB98/00299, PCT/IB98/00300, and PCT/IB98/00302. The amount used is a catalytically effective amount, suitably about 1 ppb or more, for example up to about 99.9%, more typically about 0.001 ppm or more, preferably from about 0.05 ppm to about 500 ppm (wherein "ppb" denotes parts per billion by weight and "ppm" denotes parts per million by weight).

As a practical matter, and not by way of limitation, the compositions and cleaning processes herein can be adjusted to provide on the order of at least one part per hundred million of the active bleach catalyst species in the aqueous washing medium, and will preferably provide from about 0.01 ppm to about 25 ppm, more preferably from about 0.05 ppm to about 10 ppm, and most preferably from about 0.1 ppm to about 5 ppm, of the bleach catalyst species in the wash liquor. In order to obtain such levels in the wash liquor of an automatic washing process, typical compositions herein will comprise from about 0.0005% to about 0.2%, more preferably from about 0.004% to about 0.08%, of bleach catalyst, especially manganese or cobalt catalysts, by weight of the cleaning compositions.

Enzymatic Sources of Hydrogen Peroxide

On a different track from the bleach activators illustrated hereinabove, another suitable hydrogen peroxide generating system is a combination of a C1–C4 alkanol oxidase and a C1–C4 alkanol, especially a combination of methanol oxidase (MOX) and ethanol. Such combinations are disclosed in WO 94/03003. Other enzymatic materials related to bleaching, such as peroxidases, haloperoxidases, oxidases, superoxide dismutascs, catalases and their enhancers or, more commonly, inhibitors, may be used as optional ingredients in the instant compositions.

Oxyaen Transfer Agents and Precursors

Also useful herein are any of the known organic bleach catalysts, oxygen transfer agents or precursors therefor. These include the compounds themselves and/or their precursors, for example any suitable ketone for production of dioxiranes and/or any of the hetero-atom containing analogs of dioxirane precursors or dioxiranes , such as sulfonimines R1R2C═NSO2R3, see EP 446 982 A, published 1991 and sulfonyloxaziridines, see EP 446,981 A, published 1991. Preferred examples of such materials include hydrophilic or hydrophobic ketones, used especially in conjunction with monoperoxysulfates to produce dioxiranes in situ, and/or the imines described in U.S. Pat. No. 5,576,282 and references described therein. Oxygen bleaches preferably used in conjunction with such oxygen transfer agents or precursors include percarboxylic acids and salts, percarbonic acids and salts, peroxymonosulfuric acid and salts, and mixtures thereof. See also U.S. Pat. No. 5,360,568; U.S. Pat. No. 5,360,569; U.S. Pat. No. 5,370,826 and U.S. Pat. No. 5,442,066.

Although oxygen bleach systems and/or their precursors may be susceptible to decomposition during storage in the presence of moisture, air (oxygen and/or carbon dioxide) and trace metals (especially rust or simple salts or colloidal oxides of the transition metals) and when subjected to light, stability can be improved by adding common sequestrants (chelants) and/or polymeric dispersants and/or a small amount of antioxidant to the bleach system or product. See, for example, U.S. Pat. No. 5,545,349. Antioxidants are often added to detergent ingredients ranging from enzymes to surfactants. Their presence is not necessarily inconsistent with use of an oxidant bleach; for example, the introduction of a phase barrier may be used to stabilize an apparently incompatible combination of an enzyme and antioxidant, on one hand, and an oxygen bleach, on the other. Although commonly known substances can be used as antioxidants, For example see U.S. Pat. Nos. 5,686,014, 5,622,646, 5,055,218, 4,853,143, 4,539,130 and 4,483,778. Preferred antioxidants are 3,5-di-tert-butyl-4-hydroxytoluene, 2,5-di-tert-butylhydroquinone and D,L-alpha-tocopherol.

Polymeric Soil Release Agent

The compositions according to the present invention may optionally comprise one or more soil release agents. Polymeric soil release agents are characterized by having both hydrophilic segments, to hydrophilize the surface of hydrophobic fibers, such as polyester and nylon, and hydrophobic segments, to deposit upon hydrophobic fibers and remain adhered thereto through completion of the laundry cycle and, thus, serve as an anchor for the hydrophilic segments. This can enable stains occurring subsequent to treatment with the soil release agent to be more easily cleaned in later washing procedures.

If utilized, soil release agents will generally comprise from about 0.01% to about 10% preferably from about 0.1% to about 5%, more preferably from about 0.2% to about 3% by weight, of the composition.

The following, all included herein by reference, describe soil release polymers suitable for us in the present invention. U.S. Pat. No. 5,691,298 Gosselink et al., issued Nov. 25, 1997; U.S. Pat. No. 5,599,782 Pan et al., issued Feb. 4, 1997; U.S. Pat. No. 5,415,807 Gosselink et al., issued May 16, 1995; U.S. Pat. No. 5,182,043 Morrall et al., issued Jan. 26, 1993; U.S. Pat. No. 4,956,447 Gosselink et al., issued Sep. 11, 1990; U.S. Pat. No. 4,976,879 Maldonado et al. issued Dec. 11, 1990; U.S. Pat. No. 4,968,451 Scheibel et al., issued Nov. 6, 1990; U.S. Pat. No. 4,925,577 Borcher, Sr. et al., issued May 15, 1990; U.S. Pat. No. 4,861,512 Gosselink, issued Aug. 29, 1989; U.S. Pat. No. 4,877,896 Maldonado et al., issued Oct. 31, 1989; U.S. Pat. No. 4,702,857 Gosselink et al., issued Oct. 27, 1987; U.S. Pat. No. 4,711,730 Gosselink et al., issued Dec. 8, 1987; U.S. Pat. No. 4,721,580 Gosselink issued Jan. 26, 1988; U.S. Pat. No. 4,000,093 Nicol et al., issued Dec. 28, 1976; U.S. Pat. No. 3,959,230 Hayes, issued May 25, 1976; U.S. Pat. No. 3,893,929 Basadur, issued Jul 8, 1975; and European Patent Application 0 219 048, published Apr. 22, 1987 by Kud et al.

Further suitable soil release agents are described in U.S. Pat. No. 4,201,824 Voilland et al.; U.S. Pat. No. 4,240,918 Lagasse et al.; U.S. Pat. No. 4,525,524 Tung et al.; U.S. Pat. No. 4,579,681 Ruppert et al.; U.S. Pat. No. 4,220,918; U.S. Pat. No. 4,787,989; EP 279,134 A, 1988 to Rhone-Poulenc Chemie; EP 457,205 A to BASF (1991); and DE 2,335,044 to Unilever N. V., 1974; all incorporated herein by reference.

Clay Soil Removal/Anti-redeposition Agents

The compositions of the present invention can also optionally contain water-soluble ethoxylated amines having clay soil removal and antiredeposition properties. Granular detergent compositions which contain these compounds typically contain from about 0.01% to about 10.0% by weight of the water-soluble ethoxylated amines; liquid detergent compositions typically contain about 0.01% to about 5%.

A preferred soil release and anti-redeposition agent is ethoxylated tetraethylene pentamine. Exemplary ethoxylated amines are further described in U.S. Pat. No. 4,597,898, VanderMeer, issued Jul. 1, 1986. Another group of preferred clay soil removal-antiredeposition agents are the cationic compounds disclosed in European Patent Application 111,965, Oh and Gosselink, published Jun. 27, 1984. Other clay soil removal/antiredeposition agents which can be used include the ethoxylated amine polymers disclosed in European Patent Application 111,984, Gosselink, published Jun. 27, 1984; the zwitterionic polymers disclosed in European Patent Application 112,592, Gosselink, published Jul. 4, 1984; and the amine oxides disclosed in U.S. Pat. No. 4,548,744, Connor, issued Oct. 22, 1985. Other clay soil removal and/or anti redeposition agents known in the art can also be utilized in the compositions herein. See U.S. Pat. No. 4,891,160, VanderMeer, issued Jan. 2, 1990 and WO 95/32272, published Nov. 30, 1995. Another type of preferred antiredeposition agent includes the carboxy methyl cellulose (CMC) materials. These materials are well known in the art.

Polymeric Dispersing Agents

Polymeric dispersing agents can advantageously be utilized at levels from about 0.1% to about 7%, by weight, in the compositions herein, especially in the presence of zeolite and/or layered silicate builders. Suitable polymeric dispersing agents include polymeric polycarboxylates and polyethylene glycols, although others known in the art can also be used. It is believed, though it is not intended to be limited by theory, that polymeric dispersing agents enhance overall detergent builder performance, when used in combination with other builders (including lower molecular weight polycarboxylates) by crystal growth inhibition, particulate soil release, peptization, and anti-redeposition.

Polymeric polycarboxylate materials can be prepared by polymerizing or copolymerizing suitable unsaturated monomers, preferably in their acid form. Unsaturated monomeric acids that can be polymerized to form suitable polymeric polycarboxylates include acrylic acid, maleic acid (or maleic anhydride), fumaric acid, itaconic acid, aconitic acid, mesaconic acid, citraconic acid and methylenemalonic acid. The presence in the polymeric polycarboxylates herein or monomeric segments, containing no carboxylate radicals such as vinylmethyl ether, styrene, ethylene, etc. is suitable provided that such segments do not constitute more than about 40% by weight.

Particularly suitable polymeric polycarboxylates can be derived from acrylic acid. Such acrylic acid-based polymers which are useful herein are the water-soluble salts of polymerized acrylic acid. The average molecular weight of such polymers in the acid form preferably ranges from about 2,000 to 10,000, more preferably from about 4,000 to 7,000 and most preferably from about 4,000 to 5,000. Water-soluble salts of such acrylic acid polymers can include, for example, the alkali metal, ammonium and substituted ammonium salts. Soluble polymers of this type are known materials. Use of polyacrylates of this type in detergent compositions has been disclosed, for example, in Diehl, U.S. Pat. No. 3,308,067, issued Mar. 7, 1967.

Acrylic/maleic-based copolymers may also be used as a preferred component of the dispersing/anti-redeposition agent. Such materials include the water-soluble salts of copolymers of acrylic acid and maleic acid. The average molecular weight of such copolymers in the acid form preferably ranges from about 2,000 to 100,000, more preferably from about 5,000 to 75,000, most preferably from about 7,000 to 65,000. The ratio of acrylate to maleate segments in such copolymers will generally range from about 30:1 to about 1:1, more preferably from about 10:1 to 2:1. Water-soluble salts of such acrylic acid/maleic acid copolymers can include, for example, the alkali metal, ammonium and substituted ammonium salts. Soluble acrylate/maleate copolymers of this type are known materials which are described in European Patent Application No. 66915, published Dec. 15, 1982, as well as in EP 193,360, published Sep. 3, 1986, which also describes such polymers comprising hydroxypropylacrylate. Still other useful dispersing agents include the maleic/acrylic/vinyl alcohol terpolymers. Such materials are also disclosed in EP 193,360, including, for example, the 45/45/10 terpolymer of acrylic/maleic/vinyl alcohol.

Another polymeric material which can be included is polyethylene glycol (PEG). PEG can exhibit dispersing agent performance as well as act as a clay soil removal-antiredeposition agent. Typical molecular weight ranges for these purposes range from about 500 to about 100,000, preferably from about 1,000 to about 50,000, more preferably from about 1,500 to about 10,000.

Polyaspartate and polyglutamate dispersing agents may also be used, especially in conjunction with zeolite builders. Dispersing agents such as polyaspartate preferably have a molecular weight (avg.) of about 10,000.

Other polymer types which may be more desirable for biodegradability, improved bleach stability, or cleaning purposes include various terpolymers and hydrophobically modified copolymers, including those marketed by Rohm & Haas, BASF Corp., Nippon Shokubai and others for all manner of water-treatment, textile treatment, or detergent applications.

Brightener

Any optical brighteners or other brightening or whitening agents known in the art can be incorporated at levels typically from about 0.01% to about 1.2%, by weight, into the detergent compositions herein when they are designed for fabric washing or treatment.

Specific examples of optical brighteners which are useful in the present compositions are those identified in U.S. Pat. No. 4,790,856, issued to Wixon on Dec. 13, 1988. These brighteners include the PHORWHITE series of brighteners from Verona. Other brighteners disclosed in this reference include: Tinopal UNPA, Tinopal CBS and Tinopal 5BM; available from Ciba-Geigy; Arctic White CC and Arctic White CWD, the 2-(4-styryl-phenyl)-2H-naptho[1,2-d] triazoles; 4,4'-bis-(1,2,3-triazol-2-yl)-stilbenes; 4,4'-bis (styryl)bisphenyls; and the aminocoumarins. Specific examples of these brighteners include 4-methyl-7-diethylamino coumarin; 1,2-bis(benzimidazol-2-yl) ethylene; 1,3-diphenyl-pyrazolines; 2,5-bis(benzoxazol-2-yl)thiophene; 2-styryl-naptho[1,2-d]oxazole; and 2-(stilben-4-yl)-2H-naphtho[1,2-d]triazole. See also U.S. Pat. No. 3,646,015, issued Feb. 29, 1972 to Hamilton.

Polymeric Dye Transfer Inhibiting Agents

The compositions of the present invention may also include one or more materials effective for inhibiting the transfer of dyes from one fabric to another during the cleaning process. Generally, such dye transfer inhibiting agents include polyvinyl pyrrolidone polymers, polyamine N-oxide polymers, copolymers of N-vinylpyrrolidone and N-vinylimidazole, manganese phthalocyanine, peroxidases, and mixtures thereof. If used, these agents typically comprise from about 0.01% to about 10% by weight of the composition, preferably from about 0.01% to about 5%, and more preferably from about 0.05% to about 2%.

The amine N-oxide polymers typically have a ratio of amine to the amine N-oxide of 10:1 to 1:1,000,000. However, the number of amine oxide groups present in the polyamine oxide polymer can be varied by appropriate copolymerization or by an appropriate degree of N-oxidation. The polyamine oxides can be obtained in almost any degree of polymerization. Typically, the average molecular weight is within the range of 500 to 1,000,000; more preferred 1,000 to 500,000; most preferred 5,000 to 100,000. This preferred class of materials can be referred to as "PVNO". See U.S. Pat. No. 5,633,255 to Fredj.

The most preferred polyamine N-oxide useful in the detergent compositions herein is poly(4-vinylpyridine-N-oxide) which as an average molecular weight of about 50,000 and an amine to amine N-oxide ratio of about 1:4.

Copolymers of N-vinylpyrrolidone and N-vinylimidazole polymers (referred to as a class as "PVPVI") are also preferred for use herein. Preferably the PVPVI has an average molecular weight range from 5,000 to 1,000,000, more preferably from 5,000 to 200,000, and most preferably from 10,000 to 20,000. (The average molecular weight range is determined by light scattering as described in Barth, et al., *Chemical Analysis*, Vol. 113. "Modern Methods of Polymer Characterization", the disclosures of which are incorporated herein by reference.) The PVPVI copolymers typically have a molar ratio of N-vinylimidazole to N-vinylpyrrolidone from 1:1 to 0.2:1, more preferably from 0.8:1 to 0.3:1, most preferably from 0.6:1 to 0.4:1. These copolymers can be either linear or branched.

The present invention compositions also may employ a polyvinylpyrrolidone ("PVP") having an average molecular weight of from about 5,000 to about 400,000, preferably from about 5,000 to about 200,000, and more preferably from about 5,000 to about 50,000. PVP's are known to persons skilled in the detergent field; see, for example, EP-A-262,897 and EP-A-256,696, incorporated herein by reference. Compositions containing PVP can also contain polyethylene glycol ("PEG") having an average molecular weight from about 500 to about 100,000, preferably from about 1,000 to about 10,000. Preferably, the ratio of PEG to PVP on a ppm basis delivered in wash solutions is from about 2:1 to about 50:1, and more preferably from about 3:1 to about 10:1.

The detergent compositions herein may also optionally contain from about 0.005% to 5% by weight of certain types of hydrophilic optical brighteners which also provide a dye transfer inhibition action. If used, the compositions herein will preferably comprise from about 0.01% to 1% by weight of such optical brighteners.

The hydrophilic optical brighteners useful in the present invention include, for example 4,4',-bis[(4-anilino-6-(N-2-bis-hydroxyethyl)-s-triazine-2-yl)amino]- 2,2'-stilbenedisulfonic acid and disodium salt (Tinopal-UNPA-GX), 4,4'-bis[(4-anilino-6-(N-2-hydroxyethyl-N-methylamino)-s-triazine-2-yl)amino]2,2'-stilbenedisulfonic acid disodium salt (Tinopal 5BM-GX) and 4,4'-bis[(4-anilino-6-morphilino-s-triazine-2-yl)amino]2,2'-stilbenedisulfonic acid, sodium salt (Tinopal AMS-GX) all by Ciba Geigy Corporation.

The specific optical brightener species selected for use in the present invention provide especially effective dye transfer inhibition performance benefits when used in combination with the selected polymeric dye transfer inhibiting agents hereinbefore described. The combination of such selected polymeric materials (e.g., PVNO and/or PVPVI) with such selected optical brighteners (e.g., Tinopal UNPA-GX, Tinopal 5BM-GX and/or Tinopal AMS-GX) provides significantly better dye transfer inhibition in aqueous wash solutions than does either of these two detergent composition components when used alone. Without being bound by theory the extent to which brighteners deposit on fabrics in the wash solution can be defined by a parameter called the "exhaustion coefficient". The exhaustion coefficient is in general defined as the ratio of a) the brightener material deposited on fabric to b) the initial brightener concentration in the wash liquor. Brighteners with relatively high exhaustion coefficients are the most suitable for inhibiting dye transfer in the context of the present invention.

Other, conventional optical brightener types can optionally be used in the present compositions to provide conventional fabric "brightness" benefits, rather than a dye transfer inhibiting effect. Such usage is conventional and well-known to detergent formulations.

Chelating Agents

The detergent compositions herein may also optionally contain one or chelating agents, particularly chelating agents for adventitious transition metals. Those commonly found in wash water include iron and/or manganese in water-soluble, colloidal or particulate form, and may be associated as oxides or hydroxides, or found in association with soils such as humic substances. Preferred chelants are those which effectively control such transition metals, especially including controlling deposition of such transition-metals or their compounds on fabrics and/or controlling undesired redox reactions in the wash medium and/or at fabric or hard surface interfaces. Such chelating agents include those having low molecular weights as well as polymeric types, typically having at least one, preferably two or more donor heteroatoms such as O or N, capable of co-ordination to a transition-metal, Common chelating agents can be selected from the group consisting of aminocarboxylates, aminophosphonates, polyfunctionally-substituted aromatic chelating agents and mixtures thereof, all as hereinafter defined.

Aminocarboxylates useful as optional chelating agents include ethylenediaminetetraacetates, N-hydroxyethylethylenediaminetriacetates, nitrilotriacetates, ethylenediamine tetrapropionates, triethylenetetraaminehexaacetates, diethylenetriaminepentaacetates, and ethanoldiglycines, their alkali metal, ammonium, and substituted ammonium salts, and mixtures thereof.

Aminophosphonates are also suitable for use as chelating agents in the compositions of the invention when at least low levels of total phosphorus are permitted in detergent compositions, and include ethylenediaminetetrakis (methylenephosphonates) such as DEQUEST. Preferably, these amino phosphonates do not contain alkyl or alkenyl groups having more than about 6 carbon atoms.

Polyfunctionally-substituted aromatic chelating agents are also useful in the compositions herein. See U.S. Pat. No. 3,812.044, issued May 21, 1974, to Connor et al. Preferred compounds of this type in acid form are dihydroxydisulfobenzenes such as 1,2-dihydroxy-3,5-disulfobenzene.

A preferred biodegradable chelator for use herein is ethylenediamine disuccinate ("EDDS"), especially the [S,S] isomer as described in U.S. Pat. No. 4,704,233, Nov. 3, 1987, to Hartman and Perkins.

The compositions herein may also contain water-soluble methyl glycine diacetic acid (MGDA) salts (or acid form) as a chelant or co-builder useful with, for example, insoluble builders such as zeolites, layered silicates and the like.

If utilized, chelating agents will generally comprise from about 0.001% to about 15% by weight of the detergent compositions herein. More preferably, if utilized, chelating agents will comprise from about 0.01% to about 3.0% by weight of such compositions.

Suds Suppressors

Compounds for reducing or suppressing the formation of suds can be incorporated into the compositions of the present invention when required by the intended use, especially washing of laundry in washing appliances. Other compositions, such as those designed for hand-washing, may desirably be high-sudsing and may omit such ingredients Suds suppression can be of particular importance in the so-called "high concentration cleaning process" as described in U.S. Pat. Nos. 4,489,455 and 4,489,574 and in front-loading European-style washing machines.

A wide variety of materials may be used as suds suppressors and are well known in the art. See, for example, Kirk Othmer Encyclopedia of Chemical Technology, Third Edition, Volume 7, pages 430–447 (Wiley, 1979).

The compositions herein will generally comprise from 0% to about 10% of suds suppressor. When utilized as suds suppressors, monocarboxylic fatty acids, and salts thereof, will be present typically in amounts up to about 5%, preferably 0.5%–3% by weight, of the detergent composition although higher amounts may be used. Preferably from about 0.01% to about 1% of silicone suds suppressor is used, more preferably from about 0.25% to about 0.5%. These weight percentage values include any silica that may be utilized in combination with polyorganosiloxane, as well as any suds suppressor adjunct materials that may be utilized. Monostearyl phosphate suds suppressors are generally utilized in amounts ranging from about 0.1% to about 2%, by weight, of the composition. Hydrocarbon suds suppressors are typically utilized in amounts ranging from about 0.01% to about 5.0%, although higher levels can be used. The alcohol suds suppressors are typically used at 0.2%–3% by weight of the finished compositions.

Alkoxylated Polycarboxylates

Alkoxylated polycarboxylates such as those prepared from polyacrylates are useful herein to provide additional grease removal performance. Such materials are described in WO 91/08281 and PCT 90/01815 at p. 4 et seq., incorporated herein by reference. Chemically, these materials comprise polyacrylates having one ethoxy side-chain per every 7–8 acrylate units. The side-chains are of the formula —(CH2CH2O)m(CH2)nCH3 wherein m is 2–3 and n is 6–12. The side-chains are ester-linked to the polyacrylate "backbone" to provide a "comb" polymer type structure. The molecular weight can vary, but is typically in the range of about 2000 to about 50,000. Such alkoxylated polycarboxylates can comprise from about 0.05% to about 10%, by weight, of the compositions herein.

Fabric Softeners

Various through-the-wash fabric softeners, especially the impalpable smectite clays of U.S. Pat. No. 4,062,647, Storm and Nirschl, issued Dec. 13, 1977, as well as other softener clays known in the art, can optionally be used typically at levels of from about 0.5% to about 10% by weight in the present compositions to provide fabric softener benefits concurrently with fabric cleaning. Clay softeners can be used in combination with amine and cationic softeners as disclosed, for example, in U.S. Pat. No. 4,375,416, Crisp et al, Mar. 1, 1983 and U.S. Pat. No. 4,291,071, Harris et al, issued Sep. 22, 1981. Moreover, in laundry cleaning methods herein, known fabric softeners, including biodegradable types, can be used in pretreat, mainwash, post-wash and dryer-added modes.

Perfumes

Perfumes and perfumery ingredients useful in the present compositions and processes comprise a wide variety of natural and synthetic chemical ingredients, including, but not limited to, aldehydes, ketones, esters, and the like. Also included are various natural extracts and essences which can comprise complex mixtures of ingredients, such as orange oil, lemon oil, rose extract, lavender, musk, patchouli, balsamic essence, sandalwood oil, pine oil, cedar, and the like. Finished perfumes typically comprise from about 0.01% to about 2%, by weight, of the detergent compositions herein, and individual perfumery ingredients can comprise from about 0.0001% to about 90% of a finished perfume composition.

Other Ingredients

A wide variety of other ingredients useful in detergent compositions can be included in the compositions herein, including other active ingredients, carriers, hydrotropes, processing aids, dyes or pigments, solvents for liquid formulations, solid fillers for bar compositions, etc. If high sudsing is desired, suds boosters such as the C10–C16 alkanolamides can be incorporated into the compositions, typically at 1%–10% levels. The C10–C14 monoethanol and diethanol amides illustrate a typical class of such suds boosters. Use of such suds boosters with high sudsing adjunct surfactants such as the amine oxides, betaines and sultaines noted above is also advantageous. If desired, water-soluble magnesium and/or calcium salts such as $MgCl_2$, $MgSO_4$, $CaCl_2$, $CaSO_4$ and the like, can be added at levels of, typically, 0.1%–2%, to provide additional suds and to enhance grease removal performance, especially for liquid dishwashing purposes.

Various detersive ingredients employed in the present compositions optionally can be further stabilized by absorbing said ingredients onto a porous hydrophobic substrate, then coating said substrate with a hydrophobic coating. Preferably, the detersive ingredient is admixed with a surfactant before being absorbed into the porous substrate. In use, the detersive ingredient is released from the substrate into the aqueous washing liquor, where it performs its intended detersive function.

Liquid detergent compositions can contain water and other solvents as carriers. Low molecular weight primary or secondary alcohols exemplified by methanol, ethanol, propanol, and isopropanol are suitable. Monohydric alcohols are preferred for solubilizing surfactant, but polyols such as those containing from 2 to about 6 carbon atoms and from 2 to about 6 hydroxy groups (e.g., 1,3-propanediol, ethylene glycol, glycerine, and 1,2-propanediol) can also be used. The compositions may contain from 5% to 90%, typically 10% to 50% of such carriers.

The detergent compositions herein will preferably be formulated such that, during use in aqueous cleaning operations, the wash water will have a pH of between about 6.5 and about 11, preferably between about 7.0 and 10.5, more preferably between about 7.0 to about 9.5. Liquid dishwashing product formulations preferably have a pH between about 6.8 and about 9.0. Laundry products are typically at pH 9–11. Techniques for controlling pH at recommended usage levels include the use of buffers, alkalis, acids, etc., and are well known to those skilled in the art.

Form of the Compositions

The compositions in accordance with the invention can take a variety of physical forms including granular, gel, tablet, bar and liquid forms. The compositions include the so-called concentrated granular detergent compositions adapted to be added to a washing machine by means of a dispensing device placed in the machine drum with the soiled fabric load.

The mean particle size of the components of granular compositions in accordance with the invention should preferably be such that no more that 5% of particles are greater than 1.7 mm in diameter and not more than 5% of particles are less than 0.15 mm in diameter.

The term mean particle size as defined herein is calculated by sieving a sample of the composition into a number of fractions (typically 5 fractions) on a series of Tyler sieves. The weight fractions thereby obtained are plotted against the aperture size of the sieves. The mean particle size is taken to be the aperture size through which 50% by weight of the sample would pass.

Certain preferred granular detergent compositions in accordance with the present invention are the high-density types, now common in the marketplace; these typically have a bulk density of at least 600 g/litre, more preferably from 650 g/litre to 1200 g/litre.

Surfactant Agglomerate Particles

One of the preferred methods of delivering surfactant in consumer products is to make surfactant agglomerate particles, which may take the form of flakes, prills, marumes, noodles, ribbons, but preferably take the form of granules. A preferred way to process the particles is by agglomerating powders (e.g. aluminosilicate, carbonate) with high active surfactant pastes and to control the particle size of the resultant agglomerates within specified limits. Such a process involves mixing an effective amount of powder with a high active surfactant paste in one or more agglomerators such as a pan agglomerator, a Z-blade mixer or more preferably an in-line mixer such as those manufactured by Schugi (Holland) BV, 29 Chroomstraat 8211 AS, Lelystad, Netherlands, and Gebruder Lödige Maschinenbau GmbH, D-4790 Paderboin 1, Elsenerstrasse 7–9, Postfach 2050, Germany. Most preferably a high shear mixer is used, such as a Lödige CB (Trade Name).

A high active surfactant paste comprising from 50% by weight to 95% by weight, preferably 70% by weight to 85% by weight of surfactant is typically used. The paste may be pumped into the agglomerator at a temperature high enough to maintain a pumpable viscosity, but low enough to avoid degradation of the anionic surfactants used. An operating temperature of the paste of 50° C. to 80° C. is typical.

Laundry Washing Method

Machine laundry methods herein typically comprise treating soiled laundry with an aqueous wash solution in a washing machine having dissolved or dispensed therein an effective amount of a machine laundry detergent composition in accord with the invention. By an effective amount of the detergent composition it is here meant from 40 g to 300 g of product dissolved or dispersed in a wash solution of volume from 5 to 65 litres, as are typical product dosages and wash solution volumes commonly employed in conventional machine laundry methods.

As noted, surfactants are used herein in detergent compositions, preferably in combination with other detersive surfactants, at levels which are effective for achieving at least a directional improvement in cleaning performance. In the context of a fabric laundry composition, such "usage levels" can vary widely, depending not only on the type and severity of the soils and stains, but also on the wash water temperature, the volume of wash water and the type of washing machine.

In a preferred use aspect a dispensing device is employed in the washing method. The dispensing device is charged with the detergent product, and is used to introduce the product directly into the drum of the washing machine before the commencement of the wash cycle. Its volume capacity should be such as to be able to contain sufficient detergent product as would normally be used in the washing method.

Once the washing machine has been loaded with laundry the dispensing device containing the detergent product is placed inside the drum. At the commencement of the wash cycle of the washing machine water is introduced into the drum and the drum periodically rotates. The design of the dispensing device should be such that it permits containment of the dry detergent product but then allows release of this product during the wash cycle in response to its agitation as the drum rotates and also as a result of its contact with the wash water.

Alternatively, the dispensing device may be a flexible container, such as a bag or pouch. The bag may be of fibrous construction coated with a water impermeable protective material so as to retain the contents, such as is disclosed in European published Patent Application No. 0018678. Alternatively it may be formed of a water-insoluble synthetic polymeric material provided with an edge seal or closure designed to rupture in aqueous media as disclosed in European published Patent Application Nos. 0011500, 0011501, 0011502, and 0011968. A convenient form of water frangible closure comprises a water soluble adhesive disposed along and sealing one edge of a pouch formed of a water impermeable polymeric film such as polyethylene or polypropylene.

EXAMPLES

In the following Examples, the abbreviations for the various ingredients used for the compositions have the following meanings.

| | |
|---|---|
| MLAS | Crystallinity disrupted Sodium alkyl benzene sulfonate |
| LAS | Sodium linear alkyl benzene sulfonate |
| MBASx | Mid-chain branched primary alkyl (average total carbons = x) sulfate |
| MBAExSz | Mid-chain branched primary alkyl (average total carbons = z) ethoxylate (average EO = x) sulfate, sodium salt |
| MBAEx | Mid-chain branched primary alkyl (average total carbons = x) ethoxylate (average EO = 8) |
| C18 1,4 disulfate | 2-octadecyl butane 1,4-disulfate |
| Endolase | Endoglunase enzyme of activity 3000 CEVU/g sold by NOVO Industries A/S |
| MEA | Monoethanolamine |
| DEA | Diethanolamine |
| PG | Propanediol |
| EtOH | Ethanol |
| NaOH | Solution of sodium hydroxide |
| NaTS | Sodium toluene sulfonate |
| Citric acid | Anhydrous citric acid |
| CxyFA | Clx-Cly fatty acid |
| CxyEz | A Clx-ly branched primary alcohol condensed with an average of z moles of ethylene oxide |
| Carbonate | Anhydrous sodium carbonate with a particle size between 200 μm and 900 μm |
| Citrate | Tri-sodium citrate dihydrate of activity 86.4% with a particle size distribution between 425 μm and 850 μm |
| TFAA | C16–18 alkyl N-methyl glucamide |
| LMFAA | C12–14 alkyl N-methyl glucamide |
| APA | C8–C10 amido propyl dimethyl amine |
| Fatty Acid (C12/14) | C12–C14 fatty acid |
| Fatty Acid (TPK) | Topped palm kernel fatty acid |
| Fatty Acid (RPS) | Rapeseed fatty acid |
| Borax | Na tetraborate decahydrate |
| PAA | Polyacrylic Acid (mw = 4500) |
| PEG | Polyethylene glycol (mw = 4600) |
| MES | Alkyl methyl ester sulfonate |
| SAS | Secondary alkyl sulfate |
| NaPS | Sodium paraffin sulfonate |
| CxyAS | Sodium Clx-Cly alkyl sulfate (or other salt if specified) |
| CxyEzS | Sodium Clx-Cly alkyl sulfate condensed with z moles of ethylene oxide (or other salt if specified) |
| CxyEz | A Clx-ly branched primary alcohol condensed with an average of z moles of ethylene oxide |
| QAS | R2.N + (CH3)x((C2H4O)yH)z with R2 = C8–C18 x + z = 3, x = 0 to 3, z = 0 to 3, y = 1 to 15. |
| STPP | Anhydrous sodium tripolyphosphate |
| Zeolite A | Hydrated Sodium Aluminosilicate of formula Nal2(Al02SiO2)12. 27H2O having a primary particle size in the range from 0.1 to 10 micrometers |
| NaSKS-6 | Crystalline layered silicate of formula δ-Na2Si2O5 |

-continued

| | |
|---|---|
| Bicarbonate | Anhydrous sodium bicarbonate with a particle size distribution between 400 μm and 1200 μm |
| Silicate | Amorphous Sodium Silicate (SiO2:Na2O; 2.0 ratio) |
| Sulfate | Anhydrous sodium sulfate |
| PAE | ethoxylated tetraethylene pentamine |
| PIE | ethoxylated polyethylene imine |
| PAEC | methyl quaternized ethoxylated dihexylene triamine |
| MA/AA | Copolymer of 1:4 maleic/acrylic acid, average molecular weight about 70,000. |
| CMC | Sodium carboxymethyl cellulose |
| Protease | Proteolytic enzyme of activity 4 KNPU/g sold by NOVO Industries A/S under the tradename Savinase |
| Cellulase | Cellulytic enzyme of activity 1000 CEVU/g sold by NOVO Industries A/S under the tradename |
| Carezyme | Amylolytic enzyme of activity 60 KNU/g sold by |
| Amylase | NOVO Industries A/S under the tradename Termamyl 60 T |
| Lipase | Lipolytic enzyme of activity 100 kLU/g sold by NOVO Industries A/S under the tradename Lipolase |
| PB1 | Sodium perborate monohydrate bleach |
| PB4 | Sodium perborate tetrahydrate bleach |
| Percarbonate | Sodium Percarbonate of nominal formula 2Na2CO3.3H2O2 |
| NaDCC | Sodium dichloroisocyanurate |
| NOBS | Nonanoyloxybenzene sulfonate, sodium salt |
| TAED | Tetraacetylethylenediamine |
| DTPMP | Diethylene triamine penta (methylene phosphonate), marketed by Monsanto as Dequest 2060 |
| Photobleach | Sulfonated Zinc Phthalocyanine bleach encapsulated in dextrin soluble polymer |
| Brightener 1 | Disodium 4,4'-bis(2-sulphostyryl)biphenyl |
| Brightener 2 | Disodium 4,4'-bis(4-anilino-6-morpholino-1.3.5-triazin-2-yl)amino)stilbene-2:2'-disulfonate. |
| HEDP | 1,1-hydroxyethane diphosphonic acid |
| SRP 1 | Sulfobenzoyl end capped esters with oxyethylene oxy and terephthaloyl backbone |
| SRP 2 | sulfonated ethoxylated terephthalate polymer |
| SRP 3 | methyl capped ethoxylated terephthalate polymer |
| Silicone antifoam | Polydimethylsiloxane foam controller with siloxane-oxyalkylene copolymer as dispersing agent with a ratio of said foam controller to said dispersing agent of 10:1 to 100:1. |
| Isofol 16 | Condea trademark for C16 (average) Guerbet alcohols |
| CaCl2 | Calcium chloride |
| MgCl2 | Magnesium chloride |
| Diamine | alkyl diamine, e.g., 1,3 propanediamine, Dytek EP, Dytek A, where Dytek is a Dupont tradename, 2-hydroxy propane diamine |
| DTPA | Diethylene triamine pentaacetic acid |
| Dimethicone | 40(gum)/60(fluid) weight ratio blend of SE-76 dimethicone gum from General Electric Silicones Division, and a dimethicone fluid having a viscosity of 350 centistokes. |
| NTA | Sodium Nitrilotriacetate |
| BPP | Butoxy Propoxy Propanol |
| EGME | Ethylene Glycol Monohexyl Ether |
| PEG DME | Dimethyl polyethylene glycol mwt 2000 |
| PVP K60 | vinylpryrolidone homopolymer, av mwt 160,000 |
| Minors | Low level materials such as dyes, perfumes, or colorants, and/or filler materials (e.g., talc, NaCl, sulfates). |

Unless otherwise noted, ingredients are anhydrous.

In the following Examples all levels are quoted as % by weight of the composition. The following examples are illustrative of the present invention, but are not meant to limit or otherwise define its scope. All parts, percentages and ratios used herein are expressed as percent weight unless otherwise specified.

EXAMPLE 6

The following laundry detergent compositions A to D suitable for hand-washing soiled fabrics are prepared in accord with the invention:

| | A | B | C | D |
|---|---|---|---|---|
| MLAS | 18 | 22 | 18 | 22 |
| STPP | 20 | 40 | 22 | 28 |
| Carbonate | 15 | 8 | 20 | 15 |
| Silicate | 15 | 10 | 15 | 10 |
| Protease | 0 | 0.3 | 0.3 | 0.3 |
| Cellulase | 0.5 | 0.3 | 0 | 0 |
| PB1 | 0 | 10 | 0 | 10 |
| Sodium Chloride | 25 | 15 | 20 | 10 |
| Brightener | 0–0.3 | 0.2 | 0.2 | 0.2 |
| Moisture & Minors | | - - - Balance - - - | | |

EXAMPLE 7

The following laundry detergent compositions E to H suitable for hand-washing soiled fabrics are prepared in accord with the invention:

| | E | F | G | H |
|---|---|---|---|---|
| MLAS | 22 | 16 | 11 | 1–6 |
| Any Combination of: | 0 | 0–5 | 5–15 | 10–20 |
| C45 AS | | | | |
| C45E1S | | | | |
| C45E3S | | | | |
| LAS | | | | |
| MBAS16.5 | | | | |
| MBAE2S15.5 | | | | |
| QAS | 0–5 | 0–1 | 0–5 | 0–3 |
| Any Combination of: | 0–2 | 0–4 | 0–2 | 0–2 |
| C23E6.5 | | | | |
| C45E7 | | | | |
| STPP | 5–45 | 5–45 | 5–45 | 5–45 |
| PAA | 0–2 | 0–2 | 0–2 | 0–2 |
| CMC | 0–0.5 | 0–0.5 | 0–0.5 | 0–0.5 |
| Protease | 0.1 | 0–0.5 | 0–0.5 | 0–0.5 |
| Cellulase | 0–0.3 | 0–0.3 | 0–0.3 | 0–0.3 |
| Amylase | 0–0.5 | 0–0.5 | 0–0.5 | 0.1 |
| SRP 1, 2 or 3 | 0–0.5 | 0.4 | 0–0.5 | 0–0.5 |
| Brightener 1 or 2 | 0–0.3 | 0–0.2 | 0–0.3 | 0–0.2 |
| Photobleach | 0–0.1 | 0–0.1 | 0.05 | 0–0.1 |
| Carbonate | 15 | 10 | 20 | 15 |
| Silicate | 7 | 15 | 10 | 8 |
| Sulfate | 5 | 5 | 5 | 5 |
| Moisture & Minors | | - - - Balance - - - | | |

EXAMPLE 8

The following laundry detergent compositions I to L suitable for hand-washing soiled fabrics are prepared in accord with the invention:

| | I | J | K | L |
|---|---|---|---|---|
| MLAS | 18 | 25 | 15 | 18 |
| QAS | 0.6 | 0–1 | 0.5 | 0.6 |
| Any Combination of: | 1.2 | 1.5 | 1.2 | 1.0 |
| C23E6.5 | | | | |
| C45E7 | | | | |
| C25E3S | 1.0 | 0 | 1.5 | 0 |
| STPP | 25 | 40 | 22 | 25 |
| Bleach Activator (NOBS or TAED) | 1.9 | 1.2 | 0.7 | 0–0.8 |
| PB1 | 2.3 | 2.4 | 1.5 | 0.7–1.7 |

-continued

| | I | J | K | L |
|---|---|---|---|---|
| DTPA or DTPMP | 0.9 | 0.5 | 0.5 | 0.3 |
| PAA | 1.0 | 0.8 | 0.5 | 0 |
| CMC | 0.5 | 1.0 | 0.4 | 0 |
| Protease | 0.3 | 0.5 | 0.7 | 0.5 |
| Cellulase | 0.1 | 0.1 | 0.05 | 0.08 |
| Amylase | 0.5 | 0 | 0.7 | 0 |
| SRP 1, 2 or 3 | 0.2 | 0.2 | 0.2 | 0 |
| Polymeric dispersant | 0 | 0.5 | 0.4 | 0 |
| Brightener 1 or 2 | 0.3 | 0.2 | 0.2 | 0.2 |
| Photobleach | 0.005 | 0.005 | 0.002 | 0 |
| Carbonate | 13 | 15 | 5 | 10 |
| Silicate | 7 | 5 | 6 | 7 |
| Moisture & Minors | | - - - Balance - - - | | |

EXAMPLE 9

The following laundry detergent compositions A to E are prepared in accord with the invention:

| | A | B | C | D | E |
|---|---|---|---|---|---|
| MLAS | 22 | 16.5 | 11 | 1–5.5 | 10–25 |
| Any Combination of: | 0 | 1–5.5 | 11 | 16.5 | 0–5 |
| C45 AS | | | | | |
| C45E1S | | | | | |
| LAS | | | | | |
| C16 SAS | | | | | |
| C14–17 NaPS | | | | | |
| C14–18 MES | | | | | |
| MBAS16.5 | | | | | |
| MBAE2S15.5 | | | | | |
| QAS | 0–4 | 0–4 | 0–4 | 0–4 | 0–8 |
| C23E6.5 or C45E7 | 1.5 | 1.5 | 1.5 | 1.5 | 0–4 |
| Zeolite A | 27.8 | 27.8 | 27.8 | 27.8 | 20–30 |
| PAA | 2.3 | 2.3 | 2.3 | 2.3 | 0–5 |
| Carbonate | 27.3 | 27.3 | 27.3 | 27.3 | 20–30 |
| Silicate | 0.6 | 0.6 | 0.6 | 0.6 | 0–2 |
| PB1 | 1.0 | 1.0 | 1.0 | 1.0 | 0–3 |
| Protease | 0–0.5 | 0–0.5 | 0–0.5 | 0–0.5 | 0–0.5 |
| Cellulase | 0–0.3 | 0–0.3 | 0–0.3 | 0–0.3 | 0–0.5 |
| Amylase | 0–0.5 | 0–0.5 | 0–0.5 | 0–0.5 | 0–1 |
| SRP 1 | 0.4 | 0.4 | 0.4 | 0.4 | 0–1 |
| Brightener 1 or 2 | 0.2 | 0.2 | 0.2 | 0.2 | 0–0.3 |
| PEG | 1.6 | 1.6 | 1.6 | 1.6 | 0–2 |
| Sulfate | 5.5 | 5.5 | 5.5 | 5.5 | 0–6 |
| Silicone Antifoam | 0.42 | 0.42 | 0.42 | 0.42 | 0–0.5 |

The following laundry detergent compositions F to K are prepared in accord with the invention:

| | F | G | H | I | J | K |
|---|---|---|---|---|---|---|
| MLAS | 32 | 24 | 16 | 8 | 4 | 1–35 |
| Any Combination of: | 0 | 8 | 16 | 24 | 28 | 0–35 |
| C45 AS | | | | | | |
| C45E1S | | | | | | |
| LAS | | | | | | |
| C16 SAS | | | | | | |
| C14–17 NaPS | | | | | | |
| C14–18 MES | | | | | | |
| MBAS16.5 | | | | | | |
| MBAE1.5S15.5 | | | | | | |
| C23E6.5 or C45E7 | 3.6 | 3.6 | 3.6 | 3.6 | 3.6 | 0–6 |
| QAS | 0–1 | 0–1 | 0–1 | 0–1 | 0–1 | 0–8 |
| Zeolite A | 9.0 | 9.0 | 9.0 | 9.0 | 9.0 | 0–20 |
| PAA or MA/AA | 7.0 | 7.0 | 7.0 | 7.0 | 7.0 | 0–10 |

-continued

| | F | G | H | I | J | K |
|---|---|---|---|---|---|---|
| Carbonate | 18.4 | 18.4 | 18.4 | 18.4 | 18.4 | 5–25 |
| Silicate | 11.3 | 11.3 | 11.3 | 11.3 | 11.3 | 5–25 |
| PB1 | 3.9 | 3.9 | 3.9 | 3.9 | 3.9 | 1–6 |
| NOBS | 4.1 | 4.1 | 4.1 | 4.1 | 4.1 | 0–6 |
| Protease | 0.9 | 0.9 | 0.9 | 0.9 | 0.9 | 0–1.3 |
| Amylase | 0–0.5 | 0–0.5 | 0–0.5 | 0–0.5 | 0–0.5 | 0–0.5 |
| Cellulase | 0–0.3 | 0–0.3 | 0–0.3 | 0–0.3 | 0–0.3 | 0–0.3 |
| SRP1 | 0.5 | 0.5 | 0.5 | 0.5 | 0.5 | 0–1 |
| Brightener 1 or 2 | 0.3 | 0.3 | 0.3 | 0.3 | 0.3 | 0–0.5 |
| PEG | 0.2 | 0.2 | 0.2 | 0.2 | 0.2 | 0–0.5 |
| Sulfate | 5.1 | 5.1 | 5.1 | 5.1 | 5.1 | 0–10 |
| TFAA | 0–1 | 0–1 | 0–1 | 0–1 | 0–1 | 0–3 |
| Silicone Antifoam | 0.2 | 0.2 | 0.2 | 0.2 | 0.2 | 0–0.5 |
| Moisture & Minors | - - - Balance - - - | | | | | |

EXAMPLE 11

The following liquid laundry detergent compositions L to P are prepared in accord with the invention:

| | L | M | N | O | P |
|---|---|---|---|---|---|
| MLAS | 1–7 | 7–12 | 12–17 | 17–22 | 1–35 |
| Any combination of: | 15–21 | 10–15 | 5–10 | 0–5 | 0–25 |
| C25 AExS*Na (x = 1.8–2.5) | | | | | |
| MBAE1.8S15.5 | | | | | |
| MBAS15.5 | | | | | |
| C25 AS (linear to high 2-alkyl) | | | | | |
| C14–17 NaPS | | | | | |
| C12–16 SAS | | | | | |
| C18 1,4 disulfate | | | | | |
| LAS | | | | | |
| C12–16 MES | | | | | |
| LMFAA | 0–3.5 | 0–3.5 | 0–3.5 | 0–3.5 | 0–8 |
| C23E9 or C23E6.5 | 0–2 | 0–2 | 0–2 | 0–2 | 0–8 |
| APA | 0–0.5 | 0–0.5 | 0–0.5 | 0–0.5 | 0–2 |
| Citric Acid | 5 | 5 | 5 | 5 | 0–8 |
| Fatty Acid (TPK or C12/14) | 2–7.5 | 2–7.5 | 2–7.5 | 2–7.5 | 0–14 |
| Fatty Acid (RPS) | 0–3.1 | 0–3.1 | 0–3.1 | 0–3.1 | 0–3.1 |
| EtOH | 4 | 4 | 4 | 4 | 0–8 |
| PG | 6 | 6 | 6 | 6 | 0–10 |
| MEA | 1 | 1 | 1 | 1 | 0–3 |
| NaOH | 3 | 3 | 3 | 3 | 0–7 |
| Na TS | 2.3 | 2.3 | 2.3 | 2.3 | 0–4 |
| Na formate | 0.1 | 0.1 | 0.1 | 0.1 | 0–1 |
| Borax | 2.5 | 2.5 | 2.5 | 2.5 | 0–5 |
| Protease | 0.9 | 0.9 | 0.9 | 0.9 | 0–1.3 |
| Lipase | 0.06 | 0.06 | 0.06 | 0.06 | 0–0.3 |
| Amylase | 0.15 | 0.15 | 0.15 | 0.15 | 0–0.4 |
| Cellulase | 0.05 | 0.05 | 0.05 | 0.05 | 0–0.2 |
| PAE | 0–0.6 | 0–0.6 | 0–0.6 | 0–0.6 | 0–2.5 |
| PIE | 1.2 | 1.2 | 1.2 | 1.2 | 0–2.5 |
| PAEC | 0–0.4 | 0–0.4 | 0–0.4 | 0–0.4 | 0–2 |
| SRP 2 | 0.2 | 0.2 | 0.2 | 0.2 | 0–0.5 |
| Brightener 1 or 2 | 0.15 | 0.15 | 0.15 | 0.15 | 0–0.5 |
| Silicone antifoam | 0.12 | 0.12 | 0.12 | 0.12 | 0–0.3 |
| Fumed Silica | 0.0015 | 0.0015 | 0.0015 | 0.0015 | 0–0.003 |
| Perfume | 0.3 | 0.3 | 0.3 | 0.3 | 0–0.6 |
| Dye | 0.0013 | 0.0013 | 0.0013 | 0.0013 | 0–0.003 |
| Moisture/minors | Balance | Balance | Balance | Balance | Balance |
| Product pH (10% in DI water) | 7.5–8.5 | 7.5–8.5 | 7.5–8.5 | 7.5–8.5 | 6–9.5 |

EXAMPLE 12

A non-limiting example of bleach-containing nonaqueous liquid laundry detergent is prepared having the composition as follows:

| Component | Q Wt. % | R Range (% wt.) |
|---|---|---|
| Liquid Phase | | |
| MLAS | 15 | 1–35 |
| LAS | 12 | 0–35 |
| C24E5 | 14 | 10–20 |
| Hexylene glycol | 27 | 20–30 |
| Perfume | 0.4 | 0–1 |
| Solids | | |
| Protease | 0.4 | 0–1 |
| Na3 Citrate, anhydrous | 4 | 3–6 |
| PB1 | 3.5 | 2–7 |
| NOBS | 8 | 2–12 |
| Carbonate | 14 | 5–20 |
| DTPA | 1 | 0–1.5 |
| Brightener 1 or 2 | 0.4 | 0–0.6 |
| Suds Suppressor | 0.1 | 0–0.3 |
| Minors | Balance | Balance |

The resulting composition is a stable anhydrous heavy duty liquid laundry detergent which provides excellent stain and soil removal performance when used in normal fabric laundering operations.

EXAMPLE 13

The following examples further illustrates the invention herein with respect to a hand dishwashing liquid.

| Ingredient | S % (wt.) | T Range (% wt.) |
|---|---|---|
| MLAS | 15 | 0.1–25 |
| Ammonium C23AS | 5 | 0–35 |
| C24ElS | 5 | 0–35 |
| Cocoamido MEA/DEA | 2.5 | 0–10 |
| LMFAA | 0.5 | 0–10 |
| Coconut amine oxide | 2.6 | 1–5 |
| Betaine** | 0.87/0.10 | 0–2/0–0.5 |
| C9,11E9 | 5 | 2–10 |
| NH3 xylene sulfonate | 4 | 1–6 |
| EtOH | 4 | 0–7 |
| Ammonium citrate | 0.1 | 0–1 |
| MgCl2 | 3.3 | 0–4 |
| CaCl2 | 2.5 | 0–4 |
| Diamine | 2 | 0–8 |
| Ammonium sulfate | 0.08 | 0–4 |
| Hydrogen peroxide | 200 ppm | 10–300 ppm |
| Perfume | 0.18 | 0–0.5 |
| Maxatase ® protease | 0.50 | 0–1.0 |
| Water and minors | Balance | Balance |

**Cocoalkyl betaine.

EXAMPLE 14

The following examples further illustrate the invention herein with respect to shampoo formulations.

| Component | U | V | W | X | Y |
|---|---|---|---|---|---|
| Ammonium C24E2S | 5 | 3 | 2 | 10 | 8 |
| Ammonium C24AS | 5 | 5 | 4 | 5 | 8 |
| MLAS | 0.6 | 1 | 4 | 5 | 7 |
| Cocamide MEA/DEA | 0 | 0.68 | 0.68 | 0.8 | 0 |

-continued

| Component | U | V | W | X | Y |
|---|---|---|---|---|---|
| PEG 14,000 mol. wt. | 0.1 | 0.35 | 0.5 | 0.1 | 0 |
| Cocoamidopropylbetaine | 2.5 | 2.5 | 0 | 0 | 1.5 |
| Cetylalcohol | 0.42 | 0.42 | 0.42 | 0.5 | 0.5 |
| Stearylalcohol | 0.18 | 0.18 | 0.18 | 0.2 | 0.18 |
| Ethylene glycol distearate | 1.5 | 1.5 | 1.5 | 1.5 | 1.5 |
| Dimethicone | 1.75 | 1.75 | 1.75 | 1.75 | 2.0 |
| Perfume | 0.45 | 0.45 | 0.45 | 0.45 | 0.45 |
| Water and minors | balance | balance | balance | balance | balance |

EXAMPLE 15

Various bar compositions can be made having the following composition.

| | EE | FF | |
|---|---|---|---|
| | (weight percent) | | |
| MLAS | 0–10 | 21.5 | |
| Coco fatty alcohol sulfate | 0–20 | 0 | |
| Soda Ash | 14 | 15 | |
| Sulfuric acid | 2.5 | 2.5 | |
| STP | 11.6 | 12 | |
| Calcium carbonate | 39 | 25 | |
| Zeolite | 1 | 0 | |
| Sodium Sulfate | 0 | 3 | |
| Magnesium Sulfate | 0 | 1.5 | |
| Silicate | 0 | 3.3 | |
| Talc | 0 | 10 | |
| Coco fatty alcohol | 1 | 1 | |
| PB1 | 2.25 | 5 | |
| Protease | 0 | 0.08 | |
| Coco monoethanolamide | 1.2 | 2.0 | |
| Fluorescent agents | 0.2 | 0.2 | |
| Substituted methyl cellulose | 0.5 | 1.4 | |
| Perfume | 0.35 | 0.35 | |
| DTPMP | 0.9 | 0 | |
| Moisture; minors | Balance | Balance | Balance |

EXAMPLE 16

The following laundry detergent compositions GG to KK are prepared in accord with the invention:

| | GG | HH | II | JJ | KK |
|---|---|---|---|---|---|
| MLAS | 16.5 | 12.5 | 8.5 | 4 | 1–25 |
| Any Combination of: | 0–6 | 10 | 14 | 18.5 | 0–20 |
| C45 AS | | | | | |
| C45E1S | | | | | |
| LAS | | | | | |
| C16 SAS | | | | | |
| C14–17 NaPS | | | | | |
| C14–18 MES | | | | | |
| MBAS16.5 | | | | | |
| MBAE2S15.5 | | | | | |
| QAS | 0–2 | 0–2 | 0–2 | 0–2 | 0–4 |
| TFAA | 1.6 | 1.6 | 1.6 | 1.6 | 0–4 |
| C24E3, C23E6.5 or C45E7 | 5 | 5 | 5 | 5 | 0–6 |
| Zeolite A | 15 | 15 | 15 | 15 | 10–30 |
| NaSKS-6 | 11 | 11 | 11 | 11 | 5–15 |
| Citrate | 3 | 3 | 3 | 3 | 0–8 |
| MA/AA | 4.8 | 4.8 | 4.8 | 4.8 | 0–8 |
| HEDP | 0.5 | 0.5 | 0.5 | 0.5 | 0–1 |

-continued

| | GG | HH | II | JJ | KK |
|---|---|---|---|---|---|
| Carbonate | 8.5 | 8.5 | 8.5 | 8.5 | 0–15 |
| Percarbonate or PB1 | 20.7 | 20.7 | 20.7 | 20.7 | 0–25 |
| TAED | 4.8 | 4.8 | 4.8 | 4.8 | 0–8 |
| Protease | 0.9 | 0.9 | 0.9 | 0.9 | 0–1 |
| Lipase | 0.15 | 0.15 | 0.15 | 0.15 | 0–0.3 |
| Cellulase | 0.26 | 0.26 | 0.26 | 0.26 | 0–0.5 |
| Amylase | 0.36 | 0.36 | 0.36 | 0.36 | 0–0.5 |
| SRP 1 | 0.2 | 0.2 | 0.2 | 0.2 | 0–0.5 |
| Brightener 1 or 2 | 0.2 | 0.2 | 0.2 | 0.2 | 0–0.4 |
| Sulfate | 2.3 | 2.3 | 2.3 | 2.3 | 0–25 |
| Silicone Antifoam | | 0.4 | 0.4 | 0.4 | 0–1 |
| Moisture & Minors | | - - - Balance - - - | | | |

EXAMPLE 17

The following high density detergent formulations LL to OO, according to the present invention, are prepared:

| | LL | MM | NN | OO |
|---|---|---|---|---|
| Agglomerate | | | | |
| C45AS | 11.0 | 4.0 | 0 | 14.0 |
| MLAS | 3.0 | 10.0 | 17.0 | 3.0 |
| Zeolite A | 15.0 | 15.0 | 15.0 | 10.0 |
| Carbonate | 4.0 | 4.0 | 4.0 | 8.0 |
| PAA or MA/AA | 4.0 | 4.0 | 4.0 | 2.0 |
| CMC | 0.5 | 0.5 | 0.5 | 0.5 |
| DTPMP | 0.4 | 0.4 | 0.4 | 0.4 |
| Spray On | | | | |
| C25E5 | 5.0 | 5.0 | 5.0 | 5.0 |
| Perfume | 0.5 | 0.5 | 0.5 | 0.5 |
| Dry Adds | | | | |
| C45AS | 6.0 | 6.0 | 3.0 | 3.0 |
| QAS | 0–20 | 0–20 | 0–20 | 0–20 |
| HEDP | 0.5 | 0.5 | 0.5 | 0.3 |
| SKS-6 | 13.0 | 13.0 | 13.0 | 6.0 |
| Citrate | 3.0 | 3.0 | 3.0 | 1.0 |
| TAED | 5.0 | 5.0 | 5.0 | 7.0 |
| Percarbonate | 20.0 | 20.0 | 20.0 | 20.0 |
| SRP 1 | 0.3 | 0.3 | 0.3 | 0.3 |
| Protease | 1.4 | 1.4 | 1.4 | 1.4 |
| Lipase | 0.4 | 0.4 | 0.4 | 0.4 |
| Cellulase | 0.6 | 0.6 | 0.6 | 0.6 |
| Amylase | 0.6 | 0.6 | 0.6 | 0.6 |
| Silicone antifoam | 5.0 | 5.0 | 5.0 | 5.0 |
| Brightener 1 | 0.2 | 0.2 | 0.2 | 0.2 |
| Brightener 2 | 0.2 | 0.2 | 0.2 | — |
| Balance (Water/Minors) | 100 | 100 | 100 | 100 |

EXAMPLE 18

The following are examples of hard surface cleaners

| | PP | QQ | RR | SS | TT |
|---|---|---|---|---|---|
| MLAS | 3.0 | 4.0 | 4.0 | 0.25 | 0.25 |
| NaPS | — | 1.0 | — | — | — |
| Coconut Fatty Acid | 0.5 | — | — | — | — |
| Trimethyl Ammonium C6AS | — | — | — | — | 3.1 |
| C24E5 | — | — | 2.5 | — | — |
| Carbonate | 2.0 | 2.0 | 1.0 | — | — |
| Bicarbonate | 2.0 | — | — | — | — |
| Citrate | 8.0 | 1.0 | — | 0.5 | — |

-continued

| | PP | QQ | RR | SS | TT |
|---|---|---|---|---|---|
| Sodium Sulfite | 0.2 | — | — | — | — |
| Fatty Acid (C12/14) | — | — | 0.4 | — | — |
| Sodium Cumene Sulfonate | 5.0 | — | 2.3 | — | — |
| NTA | — | 2.0 | — | — | — |
| Hydrogen Peroxide | — | — | — | — | 3.0 |
| Sulfuric Acid | — | — | — | — | 6.0 |
| Ammonia | 1.0 | — | — | 0.15 | — |
| BPP | 2.0 | 3.0 | — | — | — |
| Isopropanol | — | — | — | 3.0 | — |
| EGME | — | — | — | 0.75 | — |
| Butyl Carbitol | 9.5 | 2.0 | — | — | — |
| 2-butyl octanol | — | — | 0.3 | — | — |
| PEG DME | — | — | 0.5 | — | — |
| PVP K60 | — | — | 0.3 | — | — |
| perfume | 2.0 | 0.5 | — | — | 0.4 |
| Water + Minors, etc | Balance | Balance | Balance | Balance | Balance |

What is claimed is:

1. A cleaning composition comprising:

a) 0.1% to 99.9% by weight of said composition of an alkylarylsulfonate surfactant system comprising from 10% to 100% by weight of said surfactant system of two or more crystallinity-disrupted alkylarylsulfonate surfactants of formula:

$$(\text{B-Ar-D})_a(\text{M}^{q+})_b$$

wherein D is $SO_3^-$, M is a cation or cation mixture, q is the valence of said cation, a and b are numbers selected such that said composition is electroneutral; Ar is selected from benzene, toluene, and combinations thereof; and B comprises the sum of at least one primary hydrocarbyl moiety containing from 5 to 20 carbon atoms and one or more crystallinity-disrupting moieties wherein said crystallinity-disrupting moieties interrupt or branch from said hydrocarbyl moiety; and wherein said alkylarylsulfonate surfactant system has crystallinity disruption to the extent that its Sodium Critical Solubility Temperature, as measured by the CST Test, is no more than 40° C.; and wherein further said alkylarylsulfonate surfactant system has at least one of the following properties:

percentage biodegradation, as measured by the modified SCAS test, that exceeds tetrapropylene benzene sulfonate; and weight ratio of nonquaternary to quaternary carbon atoms in B of at least 5:1; and b) from 0.00001% to 99.9% by weight of said composition of cleaning composition adjunct ingredients, at least one of which is selected from the group consisting of: i) detersive enzymes; ii) organic detergent builders; iii) oxygen bleaching agent; iv) bleach activators; v) transition metal bleach catalysts; vi) oxygen transfer agents and precursors; vii) polymeric soil release agents; viii) water-soluble ethoxylated amines having clay soil removal and antiredeposition properties; ix) polymeric dispersing agents; x) polymeric dye transfer inhibiting agents; xi) alkoxylated polycarboxylates; and xii) mixtures thereof.

2. A cleaning composition according to claim 1 comprising from at about 0.0001% to about 10% by weight of said composition of said detersive enzyme, wherein said detersive enzyme is selected from the group consisting of proteases, cellulases, lipases, amylases, peroxidases, and mixtures thereof.

3. A cleaning composition according to claim 1 comprising at about 0.01% to about 25% by weight of said composition of said organic detergent builders selected from polycarboxylate compounds, ether hydroxypolycarboxylates, substituted ammonium salts of polyacetic acids, and mixtures thereof.

4. A cleaning composition according to claim 1 wherein the oxygen bleaching agent is selected from the group consisting of hydrogen peroxide, inorganic peroxohydrates, organic peroxohydrates, organic peroxyacids, and mixtures thereof.

5. A cleaning composition according to claim 1 wherein the bleach activator is selected from the group consisting of TAED, NOBS, and mixtures thereof.

6. A cleaning composition according to claim 1 wherein Ar is benzene.

7. A cleaning composition according to claim 1 wherein said crystallinity-disrupted alkylarylsulfonate surfactants include at least two isomers selected from:

i) ortho-, meta- and para-isomers based on positions of attachment of substituents to Ar, when Ar is a substituted or unsubstituted benzene;

ii) positional isomers based on positions of attachment of substituents to B; and iii) stercoisomers based on chiral carbon atoms in B.

8. The compositions according to claim 1 wherein the alkylarylsulfonate surfactant system further comprises from about 0% to about 85% by weight of said surfactant system of one or more noncrystallinity-disrupted alkylarylsulfonate surfactants of formula:

$$(\text{L-Ar-D})_a(\text{M}^{q+})_b$$

wherein D, M, q, a, b, Ar, are as defined for the crystallinity-disrupted alkylarylsulfonate surfactants; and L is a linear hydrocarbyl moiety containing from 5 to 20 carbon atoms.

9. The composition according to claim 1 wherein said crystallinity-disrupted alkylarylsulfonate surfactants include two or more homologs, and two or more isomers of at least one of the homologs.

10. The composition according to claim 9 wherein B includes both odd and even carbon chain lengths.

11. The composition according to claim 1 wherein the primary moiety of B is exactly one linear hydrocarbyl moiety having from 7 to 16 carbon atoms and wherein said crystallinity-disrupting moiety or moieties are selected from:

i) branches attached to B selected from C1–C3 alkyl, C1–C3 alkyloxy, hydroxy and mixtures thereof;

ii) moieties which interrupt the structure of B, selected from ether, sulfone, silicone; and iii) mixtures thereof.

12. The composition according to claim 1 wherein at least about 60% by weight of said surfactant system of said crystallinity-disrupted alkylarylsulfonate surfactants is in the form of isomers wherein, Ar is attached to B at the second or third carbon atom in said linear hydrocarbyl moiety thereof.

13. The cleaning composition according to claim 1 wherein said cleaning composition is in the form of a liquid, a granule, tablet, agglomerate or a powder.

14. A cleaning composition according to claim 1 wherein said cleaning composition adjunct further comprises one or more materials selected from the group consisting of: surfactants other than said crystallinity-disrupted alkylarylsulfonate surfactants, soluble magnesium salts, organic diamines, phosphate builders, aluminosilicate builders, antifoaming agents, foam boosters, fabric softeners, and mixtures thereof.

15. A cleaning composition according to claims 1 wherein said alkylarylsulfonate surfactant system has crystallinity disruption to the extent that its Sodium Critical Solubility Temperature, as measured by the CST Test, is no more than about 20° C.

16. A cleaning composition according to claim 15 wherein said alkylarylsulfonate surfactant system has crystallinity disruption to the extent that its Sodium Critical Solubility Temperature, as measured by the CST Test, is no more than about 5° C.

17. A cleaning composition according to claim 1 wherein said alkylarylsulfonate surfactant system has crystallinity disruption to the extent that its Calcium Critical Solubility Temperature, as measured by the CST Test, is no more than about 80° C.

18. A cleaning composition according to claim 17 wherein said alkylarylsulfonate surfactant system has crystallinity disruption to the extent that its Calcium Critical Solubility Temperature, as measured by the CST Test, is no more than about 40° C.

19. A cleaning composition according to claim 18 wherein said alkylarylsulfonate surfactant system has crystallinity disruption to the extent that its Calcium Critical Solubility Temperature, as measured by the CST Test, is no more than about 20° C.

20. A cleaning composition according to claim 1 wherein said percentage biodegradation, as measured by the modified SCAS Test, is at least about 60%.

* * * * *